US006354586B1

(12) United States Patent
Samoto

(10) Patent No.: US 6,354,586 B1
(45) Date of Patent: Mar. 12, 2002

(54) SHEET FEEDER

(75) Inventor: Kenji Samoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/654,415

(22) Filed: Sep. 1, 2000

(30) Foreign Application Priority Data

Sep. 1, 1999 (JP) ..... 11-247235

(51) Int. Cl.[7] ..... B65H 1/08
(52) U.S. Cl. ..... 271/127; 271/160; 271/164
(58) Field of Search ..... 271/126, 127, 271/118, 147, 160, 164

(56) References Cited

U.S. PATENT DOCUMENTS 5,078,380 A * 1/1992 Kitazawa ..... 271/127
5,228,676 A * 7/1993 Arai et al. ..... 271/126
5,419,543 A * 5/1995 Nakamura et al. ..... 271/118
6,059,282 A * 5/2000 Jang ..... 271/160

FOREIGN PATENT DOCUMENTS

JP 0176227 * 7/1988 ..... 271/127

* cited by examiner

*Primary Examiner*—H. Grant Skaggs
(74) *Attorney, Agent, or Firm*—Oliff & Berridge, PLC

(57) ABSTRACT

After the uppermost sheet is separated from a stack of sheets on a pressure plate by a sheet feed roller, a push plate is lowered by a lowering mechanism by a predetermined distance and is halted at a plate standby position higher than the plate lower position by the engagement of a ratchet pawl with a lock pawl. Accordingly, when the pressure plate is lowered after the sheet is separated, it is unnecessary to lower the push plate to the plate lower position. Thus, the moving up/down distance of the pressure plate is shortened when the sheet is separated and conveyed, resulting in a reduction in impact noise generated upon the contact of the sheet and the sheet feed roller. In addition, because the moving distance is shortened, the sheet feed speed per sheet is increased.

20 Claims, 10 Drawing Sheets

SHEET FEEDER

BACKGROUND OF THE INVENTION

1. Field of Invention

The invention relates to a sheet feeder in which individual sheets are separately fed by a sheet feed roller.

2. Description of Related Art

A sheet feeder that feeds sheets to a printer, such as an ink-jet printer and a laser printer, typically includes a sheet feed cassette for storing a stack of sheets to be printed, a vertically movable pressure plate disposed at the bottom of the sheet feed cassette to support thereon the sheets, a sheet feed roller for feeding the sheets from the pressure plate, a push plate for moving up the pressure plate and bringing the sheets on the pressure plate into contact with the sheet feed roller, and a separation pad for separating a single sheet from the stack in contact with the sheet feed roller.

In a printer having such a sheet feeder, when a single sheet is separated from the stack, the pressure plate is moved up by the push plate toward the sheet feed roller and the stack on the pressure plate is brought into contact with the sheet feed roller with an optimum pressure. After that, when the sheet feed roller rotates, a single sheet is separated from the stack by the sheet feed roller and the separation pad.

On the other hand, when the separated sheet is conveyed, the push plate is lowered toward the bottom of the sheet feed cassette, and the pressure plate is also lowered to the bottom of sheet feed cassette. When the pressure plate is lowered, the stack on the pressure plate is apart from the sheet feed roller. This prevents the remaining sheets from being pressed against the sheet feed roller by the pressure plate. Accordingly, the next sheet beneath the separated sheet is prevented from being conveyed together with the seperated sheet. In addition, the rotation load of the sheet feed roller is reduced.

After that, when a sheet feed command is issued from a controller, the pressure plate is moved up by the push plate from the bottom of the sheet feed cassette toward the sheet feed roller, and the next sheet stacked on the pressure plate is brought into contact with the sheet feed roller. Then, the next sheet starts being conveyed.

In the above-described sheet feeder, when the sheet separated by the sheet feed roller and the separation pad is conveyed, the pressure plate should be lowered to the bottom of the sheet feed cassette by lowering the push plate from the upper position where the stack is in contact with the sheet feed roller to the lower position where the stack is away from the sheet feed roller.

After that, when the next sheet is separated, the push plate should be raised again from the lower position to the upper position to bring the next sheet stacked on the pressure plate into contact with the sheet feed roller.

In this way, when the pressure plate is moved up from the bottom of the sheet feed cassette toward the sheet feed roller by moving up the push plate from the lower position to the upper position, the moving distance of the pressure plate is so long that high impact noise is generated upon the contact between the sheets stacked on the pressure plate and the sheet feed roller. As a result, considerable noise is produced during the operation of the sheet feeder.

In order to separately feed a single sheet, the push plate that pushes the pressure plate should be vertically moved from the position where the sheets are in contact with the sheet feed roller and the position where the sheets are away from the sheet feed roller. Thus, another problem arises in that it takes a long time to separately feed a single sheet and, as a result, the sheet feed speed of the sheet feeder becomes low. To overcome this problem and to move the push plate at high speed, use of a high torque drive motor is conceivable. However, such a motor is expensive and results in an increase in the total production cost of the sheet feeder.

SUMMARY OF THE INVENTION

In view of the foregoing problems, one aspect of the invention is to provide a sheet feeder that generates low impact noise when a sheet support member is vertically moved by a pushing member, uses a low-powered lowering mechanism to lower the pushing member, and can reduce the sheet feed time per sheet to increase the sheet feed speed.

A sheet feeder according to the invention may include a sheet support member that supports thereon a stack of sheets, a sheet feed roller that is rotatably disposed above one end of the sheet support member and separates a single sheet from the stack of sheets and then conveys the separated single sheet, a pushing member that is vertically movable and pushes the sheet support member toward the sheet feed roller between a lower position where the stack of sheets is away from the sheet feed roller and an upper position where the stack of sheets is in contact with the sheet feed roller, an urging member that urges the pushing member from the lower position to the upper position, a lowering device that lowers the pushing member urged by the urging member by a predetermined distance from the upper position when the sheet feed roller conveys the separated single sheet, a halting device that halts the pushing member lowered by the lowering device at a position lower than the upper position and higher than the lower position, and a halt release device that releases the halted pushing member.

In the sheet feeder as structured above, a stack of sheets is put on the sheet support member when the pushing member is at the lower position. Thus, the stack on the sheet support member is away from the sheet feed roller. After that, the pushing member is urged from the lower position to the upper position and moved up toward the upper position. When the pushing member reaches the upper position, the stack on the sheet support member is brought into contact with the sheet feed roller. Then, a single sheet is separated from the stack in contact with the sheet feed roller as the sheet feed roller rotates.

After the single sheet is separated, the pushing member is lowered by the predetermined distance by the lowering device and halted by the halting device at a position lower than the upper position and higher than the lower position. The stack on the sheet support member falls away by the predetermined distance from the sheet feed roller. Thus, the separated sheet is conveyed by the sheet feed roller without being pressed by the sheet support member pushed by the pushing member against the sheet feed roller.

After the sheet is conveyed by the sheet feed roller, the halt release device releases the pushing device halted by the halting device. The pushing device is urged from the halted position toward the upper position by an urging force of the urging member. Thereby, the pushing member returns again to the upper position, and the sheet support member is pushed up toward the sheet feed roller. The next sheet of the stack is brought into contact with the sheet feed roller so as to be separated and conveyed.

The lowering device of the sheet feeder may include a ratchet gear having, on its outer circumference, a plurality of engaging pawls and rotated in a forward direction during upward movement of the pushing member toward the upper position and rotated in a reverse direction, which is opposite to the forward direction, during downward movement of the pushing member toward the lower position, a first cam member rotated as the sheet feed roller rotates, an actuating member projecting toward the first cam member and pushed by the first cam member as the sheet feed roller rotates, and an engaging member that, when the actuating member is pushed by the first cam member, engages one of the engaging pawls and swings in a same direction as the reverse rotation direction of the ratchet gear so as to rotate the ratchet gear by a predetermined angle in the reverse direction.

In the lowering device as structured above, the first cam member is rotated as the sheet feed roller rotates. The actuating member is moved by the rotation of the first cam member toward a certain direction such that the engaging member engages with one of the engaging pawls of the ratchet gear. When the actuating member is further moved by the first cam member, the engaging member swings in the same direction as the reverse rotation direction of the ratchet gear. Simultaneously, the ratchet gear is rotated in the reverse direction. Thereby, the pushing member is lowered by the predetermined distance toward the lower position.

Further, the first cam member is structured to release the actuating member when the ratchet gear has been rotated by the predetermined angle in the reverse direction and, upon release of the actuating member by the first cam member, the engaging member is released by one of the engaging pawls.

When the ratchet gear has been rotated by the engaging member by a predetermined angle, the actuating member is released by the first cam member, and thereby the engaging member is disengaged from one of the engaging pawls of the ratchet gear. This disengagement prevents the ratchet gear from rotating excessively in the reverse direction and the pushing member from being lowered more than the predetermined distance.

Further, the halting device of the sheet feeder may include a locking member that is engageable with one of the engaging pawls and, when engaged with one of the engaging pawls, restricts the forward rotation of the ratchet gear while permitting the reverse rotation of the ratchet gear.

Accordingly, the engagement of the locking member with one of the engaging pawls restricts the forward rotation of the ratchet gear. This restriction prevents the pushing member from moving up and halts the pushing member at the position lowered by the predetermined distance from the upper position. In addition, the locking member, when engaged with one of the engaging pawls, permits the reverse rotation of the ratchet gear. Thus, the locking member allows the pushing member to be lowered by the reverse rotation of the ratchet gear, while restricting the forward rotation of the ratchet gear and preventing the upward movement of the pushing member.

Further, the halt release device of the sheet feeder may include a second cam member that is rotated as the sheet feed roller rotates and pushes the locking member so as to release engagement between the locking member and one of the engaging pawls.

Accordingly, the engaging member, when pushed down by the second cam member, is disengaged from one of the engaging pawls. This disengagement allows the ratchet gear to rotate in the forward direction and the pushing member to move up toward the upper position. The pushing member is urged toward the upper position. The ratchet gear is rotated in the forward direction by this urging force and, in response to the rotation, the pushing member returns to the upper position.

The sheet feeder may further include an attenuator that attenuates the moving speed of the pushing member when the pushing member is moved upward by an urging force of the urging member.

Accordingly, impact of a stack of sheets on the sheet support member with the sheet feed roller is reduced. Because the stack on the sheet support member is prevented from colliding violently with the sheet feed roller, impact noise generated during upward movement of the push plate 24 is reduced.

The sheet feeder may further include a case and a sheet feed cassette detachably attached to the case and provided with the sheet support member. The sheet feed cassette may include an urging force starting member that makes the urging member start generating an urging force.

When the sheet feed cassette is attached to the case, the urging force starting member makes the urging member start generating an urging force. The generated urging force makes the pushing member move up toward the upper position.

Still further, the urging member of the sheet feeder may be made of an elastic material.

Accordingly, no electric device, such as a motor, is required, as an urging force generating device, to urge the pushing member. Thus, the total production cost of the sheet feeder can be reduced.

BRIEF DESCRIPTION OF THE DRAWINGS

A preferred embodiment of the invention will be described in detail with reference to the following figures wherein.

DETAILED DESCRIPTION OF PREFERRED EMBODIMENTS

A preferred embodiment of the invention will now be described with reference to the attached figures.

Figure 1:
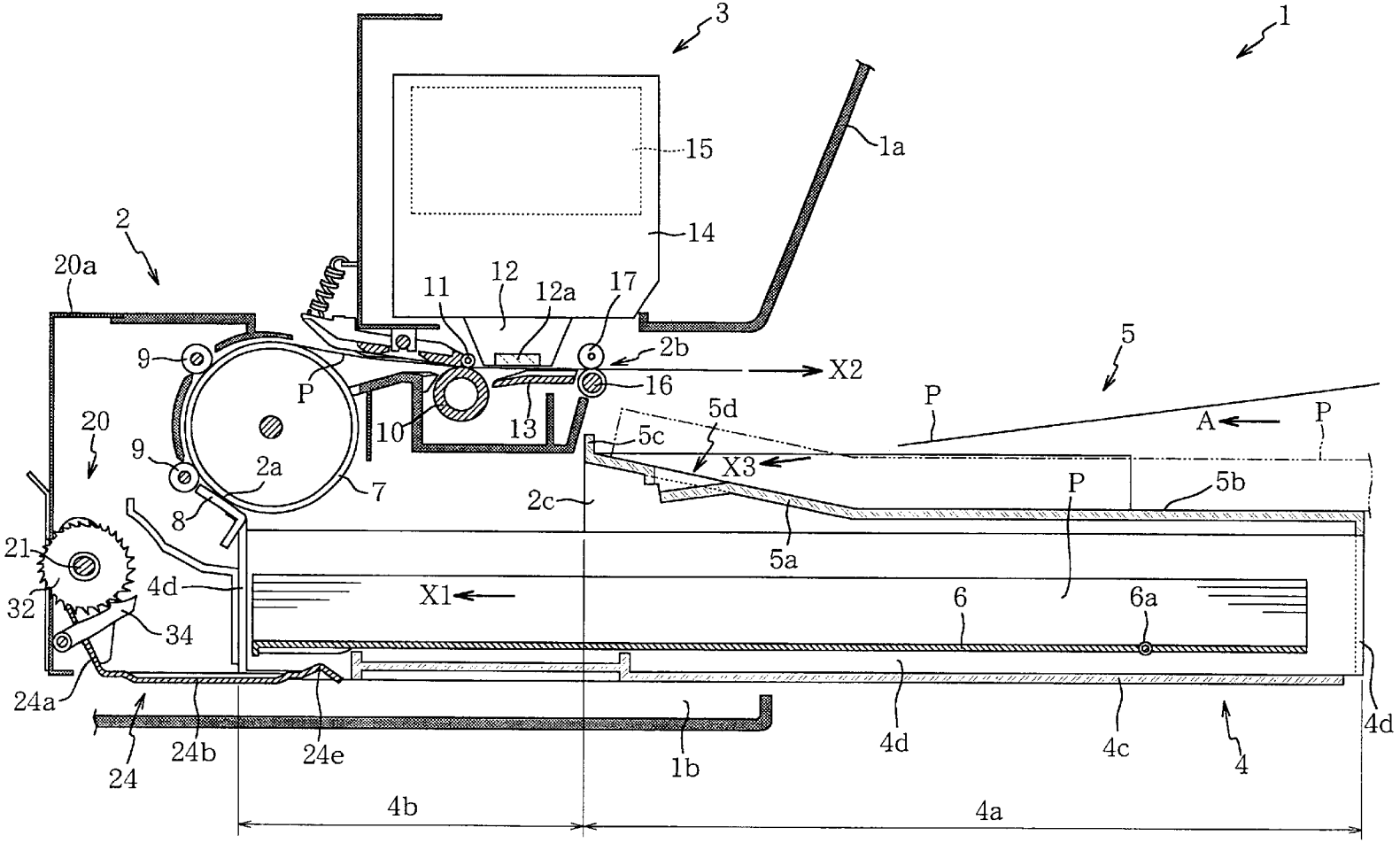
FIG. 1 is a side sectional view showing the internal structure of a printer having a sheet feeder as one embodiment of the invention, where a push plate is at its lower position.

FIG. 1 is a sectional view showing the internal structure of a printer (image forming device) 1 having a sheet feeder 2 as an embodiment of the invention and also schematically showing a pushing device 20, which will be described later. In FIG. 1, the push plate 24 is at its lower position.

Arrows shown in FIG. 1 indicate particular directions. Arrow A indicates the direction in which a sheet feed cassette 4 is inserted into a cassette inserting section 1*b*. Arrow X1 indicates the sheet feed direction in which a sheet P to be printed is fed into a sheet feed port 2*a*. Arrow X2 indicates the sheet discharge direction in which a sheet P is discharged onto a cassette cover 5. Arrow X3 indicates the direction in which a sheet P to be printed is manually fed from the cassette cover 5.

The printer 1 is a so-called ink-jet printer and includes a sheet feeder 2 for feeding sheets P individually and a printing device 3 for printing an image on a sheet P. In the printer 1, the sheet feeder 2 and the printing device 3 are housed in a main case 1*a*, which is box-shaped and made of a synthetic resin.

The sheet feeder 2 has an automatic sheet feed function for feeding an individual sheet from a stack of sheets P in the sheet feed cassette 4, and a manual sheet feed function for feeding sheets P that are manually inserted from a manual sheet feed port 5*d* of the cassette cover 5. The sheet feeder 2 has the sheet feed port 2*a* into which a new sheet P is fed, and a sheet discharge port 2*b* through which a sheet P fed into the sheet feed port 2*a* is discharged to the outside of the main case 1*a*.

The sheet feed cassette 4 is disposed upstream (on the right side in FIG. 1) of the sheet feed port 2*a* of the sheet feeder 2 and stores a stack of new sheets P. The sheet feed cassette 4 is detachably inserted into the cassette inserting section 1*b* at a lower portion of the main case 1*a*.

The sheet feed cassette 4 is a shallow, hollow box having an open top surface (hereinafter referred to simply as an "open surface"). The cassette cover 5 is detachably attached to the open surface on the side (right side in FIG. 1) away from the sheet feed port 2*a*. Thus, the sheet feed cassette 4 has a covered portion 4*a* where the open surface on the side (right side in FIG. 1) away from the sheet feed port 2*a* is covered, and an uncovered portion 4*b* where the open surface on the side (left side in FIG. 1) near the sheet feed port 2*a* remains open.

A flat bottom plate 4*c* is provided internally at the bottom of the sheet feed cassette 4. A flat pressure plate 6 is provided internally on the bottom plate 4*c* in the longitudinal direction (rightward/leftward direction in FIG. 1) of the sheet feed cassette 4.

The cassette cover 5 is provided to cover the open surface of the covered portion 4*a* of the sheet feed cassette 4. The cassette cover 5 has a sheet edge-receiving portion 5*a* that receives the trailing edge side (on the left side in FIG. 1) of a sheet P discharged (in the direction of arrow X2 in FIG. 1) from the sheet discharge port 2*b*, and a flat sheet-holding portion 5*b* that holds the leading edge side of a discharged sheet P.

The sheet edge-receiving portion 5*a* extends from the lower portion of the sheet discharge port 2*b* while being tilted down toward the sheet discharge direction (indicated by arrow X2 in FIG. 1). On the other hand, the sheet-holding portion 5*b* extends substantially horizontally from the lower end of the sheet edge-receiving portion 5*a*, that is, from the end (on the right side in FIG.1) thereof opposite to the sheet discharge port 2*b*, toward the sheet discharge direction (indicated by arrow X2 in FIG. 1).

Thus, the cassette cover 5 holds a sheet P discharged from the sheet discharge port 2*b* such that its trailing edge (on the left side in FIG. 1) received by the sheet edge-receiving portion 5*a* is tilted up toward the sheet discharge port 2*b*.

A communicating space 2*c* that communicates with the sheet feed port 2*a* is defined below the sheet edge-receiving section, that is, between the lower surface of the sheet-edge receiving portion 5*a* and the upper surface of a stack of sheets in the sheet feed cassette 4. The communication space 2*c* allows a sheet P manually fed from the cassette cover 5 to be guided therethrough to the sheet feed port 2*a*.

A substantially flat partition 5*c* is vertically provided above the communicating space 2*c*, on the upper end of the sheet-edge receiving portion 5*a*, that is, on the end (on the left side in FIG. 1) near the sheet discharge port 2*b*. The partition 5*c* is provided to separate the communicating space 2*c* from the space above the sheet edge-receiving portion 5*a* (cassette cover 5).

Accordingly, sheets P discharged from the print discharge port 2*b* are prevented by the partition 5*c* from slipping down from the upper end of the sheet edge-receiving portion 5*a* to the communicating space 2*c*. In other words, printed sheets P are prevented from entering the communicating space 2*c* and from being supplied again into the sheet feed port 2*a*. In addition, the cassette cover 5 holds sheets P discharged from the sheet discharge port 2*b* with their trailing edges (on the left side in FIG. 1) tilted up toward the sheet discharge port 2*b*, thereby preventing the discharged sheets P from crossing over the partition 5*c* and entering the communicating space 2*c*.

The manual sheet feed port 5*d* is provided wide open at a substantially central part of the tilted sheet edge-receiving portion 5*a*, substantially perpendicularly to the tilted direction. The manual sheet feed port 5*d* allows a new sheet P to be manually inserted from the cassette cover 5. Also, the manual sheet feed port 5*d* allows the space above the sheet edge-receiving portion 5*a* (cassette cover 5) to communicate with the communicating space 2*c*. Thus, a sheet manually inserted from the upper side of the sheet edge-receiving portion 5*a* enters the communicating space 2*c* below the sheet edge-receiving portion and passes therethrough to the sheet feed port 2*a*.

The manual sheet feed port 5*d* is provided on the tilted-down side of the sheet edge-receiving portion 5*a* with respect to the trailing edges (on the left side in FIG. 1) of discharged sheets P held by the sheet edge-receiving portion 5*a*. Thus, the trailing edges of sheets P discharged from the sheet discharge port 2*b* are prevented from mistakenly entering the manual sheet feed port 5*d*. In addition, the sheet edge-receiving portion 5*a* holds the discharged sheets P with their trailing edges (on the left side in FIG. 1) tilted up toward the sheet discharge port 2*b*, so that the trailing edges hardly enter the manual sheet feed port 5*d*.

The pressure plate 6 supports thereon a stack of sheets P stored in the sheet feed cassette 4. A pivot shaft 6*a* is provided on a longitudinal side (on the right side in FIG. 1) of the pressure plate 6. The pivot shaft 6*a* is rotatably supported by the sheet feed cassette 4. The pressure plate 6 is supported by the pivot shaft 6*a* so as to vertically swing about the pivot shaft 6*a*.

The pushing device 20 is disposed on the opposite side (on the left side in FIG. 1) of the pressure plate 6 from the pivot shaft 6*a*. The pushing device 20 has a push plate 24 that moves up the pressure plate 6. The right edge (FIG. 1) of the push plate 24 makes contact with the lower surface of the pressure plate 6. As the push plate 24 moves up, the pressure plate 6 swings upward about the pivot shaft 6*a* so that the sheets P supported thereon make contact with the lower surface of the sheet feed roller 7. The pushing device 20 will be described in more detail later.

The sheet feed roller 7 is disposed above the uncovered portion 4*b* of the sheet feed cassette 4. The lower surface of the sheet feed roller 7 is opposed to the upper surface of the sheets P stacked in the sheet feed cassette 4. The sheet feed roller 7 is supported by the main case 1*a* so as to rotate clockwise to supply the sheets P. A separation pad 8, made of a synthetic resin, such as polyurethane, having an appropriate surface friction coefficient, is disposed underneath the sheet feed roller 7 to separate one sheet from a stack of sheets P in cooperation with the sheet feed roller 7. Accordingly, as the sheet feed roller 7 rotates, the uppermost sheet is separated, with the aid of the separation pad 8, from a stack of sheets P in the sheet feed cassette 4 and is conveyed. The sheet feed port 2*a* for supplying sheets P to the printing device 3 is formed by contact portions between the sheet feed roller 7 and the separation pad 8.

A pair of driven rollers 9, 9 are rotatably supported by the main case 1*a* so as to contact the sheet feed roller 7. The sheet feed roller 7 and the driven rollers 9, 9 pinch a sheet P therebetween and convey it. The sheet feed direction (indicated by arrow X1 in FIG. 1) on the upstream side of the sheet feed roller 7 is opposite to that (indicated by arrow X2 in FIG. 1) on the downstream side thereof.

In other words, in the printer 1, the sheet feed path defined by the sheet feed roller 7 and the driven rollers 9, 9 is bent into a U shape. A sheet P having passed along the sheet feed path and having undergone printing is discharged onto the upper surface of the cassette cover 5 of the sheet feed cassette 4 in which new sheets P are stored. With this structure, the printer 1 is made compact in size.

A linefeed roller 10 is disposed downstream of the sheet feed roller 7 to guide a sheet fed by the sheet feed roller 7 to a printhead 12. The linefeed roller 10 is supported, similarly to the sheet feed roller 7, by the main case 1*a* so as to rotate clockwise. A pressure roller 11 is disposed above the linefeed roller 10 to press the sheet P against the linefeed roller 10. The pressure roller 11 operates in cooperation with the linefeed roller 10 to guide the sheet P to the printing device 3.

The printing device 3 includes the printhead 12 that ejects ink onto the sheet P to accomplish printing. The printhead 12 is disposed downstream of the linefeed roller 10 and the pressure roller 11. Nozzles 12*a*, through which ink is ejected onto the sheet P, are formed at the bottom of the printhead 12. Below the nozzles 12*a*, a flat platen 13 is disposed to support the sheet P. Above the platen 13, a carriage 14 is disposed to mount thereon the printhead 12. The carriage 14 is translatable in the width direction of the sheet P. The carriage 14 has, besides the printhead 12, an ink tank 15 for storing ink to be supplied to the printhead 12.

Provided downstream of the printhead 12 and the platen 13 are a discharge roller 16 for discharging the sheet P discharged from the platen 13 to the outside of the main case 1*a*, and a pressure roller 17 for pressing the sheet P against the discharge roller 13.

Downstream of the discharge roller 16 and the pressure roller 17, the sheet discharge port 2*b*, thorough which the sheet P is discharged to the outside of the main case 1*a*, is formed higher than the sheet feed port 2*a* of the sheet feeder 2.

Downstream of the sheet discharge port 2*b*, the cassette cover 5 is disposed to cover the covered portion 4*a* of the sheet feed cassette 4. The cassette cover 5 serves as a holding member (a so-called output tray) that holds discharged printed sheets P and also as a holding member (a so-called manual feed tray) that holds new manually fed sheets P. The cassette cover 5 extends from a lower portion of the sheet discharge port 2*b* toward the sheet discharge direction (indicated by arrow X2 in FIG. 1) to cover the sheet feed cassette 4. Printed sheets P discharged from the sheet discharge port 2*b* are stacked on the upper surface of the cassette cover 5.

Figure 2:
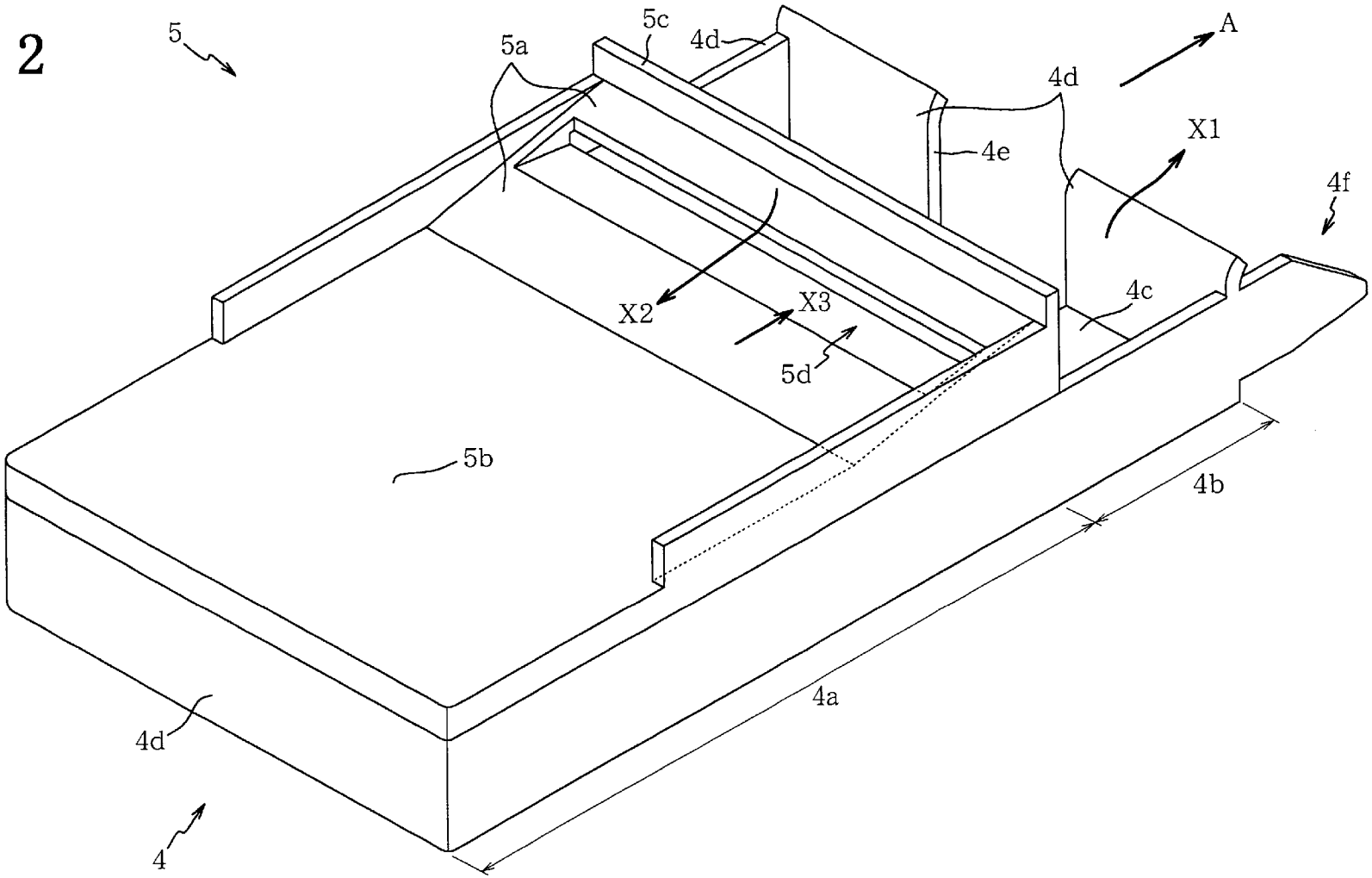
FIG. 2 is an external perspective view of a sheet feed cassette and a cassette cover.

FIG. 2 is an external perspective view of the sheet feed cassette 4 and the cassette cover 5. The pressure plate 6 disposed within the sheet feed cassette 4 is omitted from FIG. 2. Arrows shown in FIG. 2, as in the FIG. 1, indicate particular directions. Arrow A indicates the direction in which the sheet feed cassette 4 is inserted. Arrow X1 indicates the sheet feed direction in which a sheet P is fed into the sheet feed port 2*a*. Arrow X2 indicates the sheet discharge direction in which a sheet P is discharged onto the cassette cover 5, and arrow X3 indicates the direction in which a sheet P is manually fed from the cassette cover 5.

The sheet feed cassette 4 includes the above-mentioned substantially rectangular, flat bottom plate 4*c* at the bottom thereof. Sidewalls 4*d* extends upward from four edges of the bottom plate 4*c* of the sheet feed cassette 4. Thus, the sheet feed cassette 4 is a rectangular parallelepiped formed by the bottom plate 4*c* and the sidewalls 4*d*, with its top surface open, so as to accommodate a stack of sheets P.

In addition, a substantially rectangular cutaway 4*e* is formed in a sidewall 4*d* on one longitudinal end of the sheet feed cassette 4, that is, in an upright sidewall 4*d* on the inserting direction side (indicated by arrow A). The sheet feed cassette 4 communicates with the outside thorough the cutaway 4*e*. The cutaway 4*e* for guiding the push plate 24 of the pushing device 20 is formed such that the push plate 24 can be inserted thereinto. Thus, the leading edge of the push plate 24 is allowed to make contact with the lower surface of the pressure plate 6 in the sheet feed cassette 4.

On one side (right side in FIG. 2) of the sidewall 4*d* with the cutaway 4*e*, a substantially flat push-up plate 4*f* is provided so as to extend toward the sheet feed cassette inserting direction (indicated by arrow A in FIG. 2). When the sheet feed cassette 4 is inserted into the cassette inserting section 1*b*, the push-up plate 4*f* pushes up an urging arm 22 (FIGS. 3 and 4) of the pushing device 20. The urging arm 22 pushed up by the push-up plate 4*f* elastically deforms an elastic spring 25 of the pushing device 20, thereby applying an urging force to the push plate 24.

The cassette cover 5 includes the sheet edge-receiving portion 5*a* and the sheet-holding portion 5*b*, as described above. The partition 5*c* is vertically provided at the upper end of the sheet edge-receiving portion 5*a*, entirely along the width direction thererof. The manual sheet feed port 5*d* is wide open in the width direction of the sheet edge-receiving portion 5*d*. The longitudinal opening width of the manual sheet feed port 5*d* is slightly smaller than the width of the sheet edge-receiving portion 5*a*.

Figure 3:
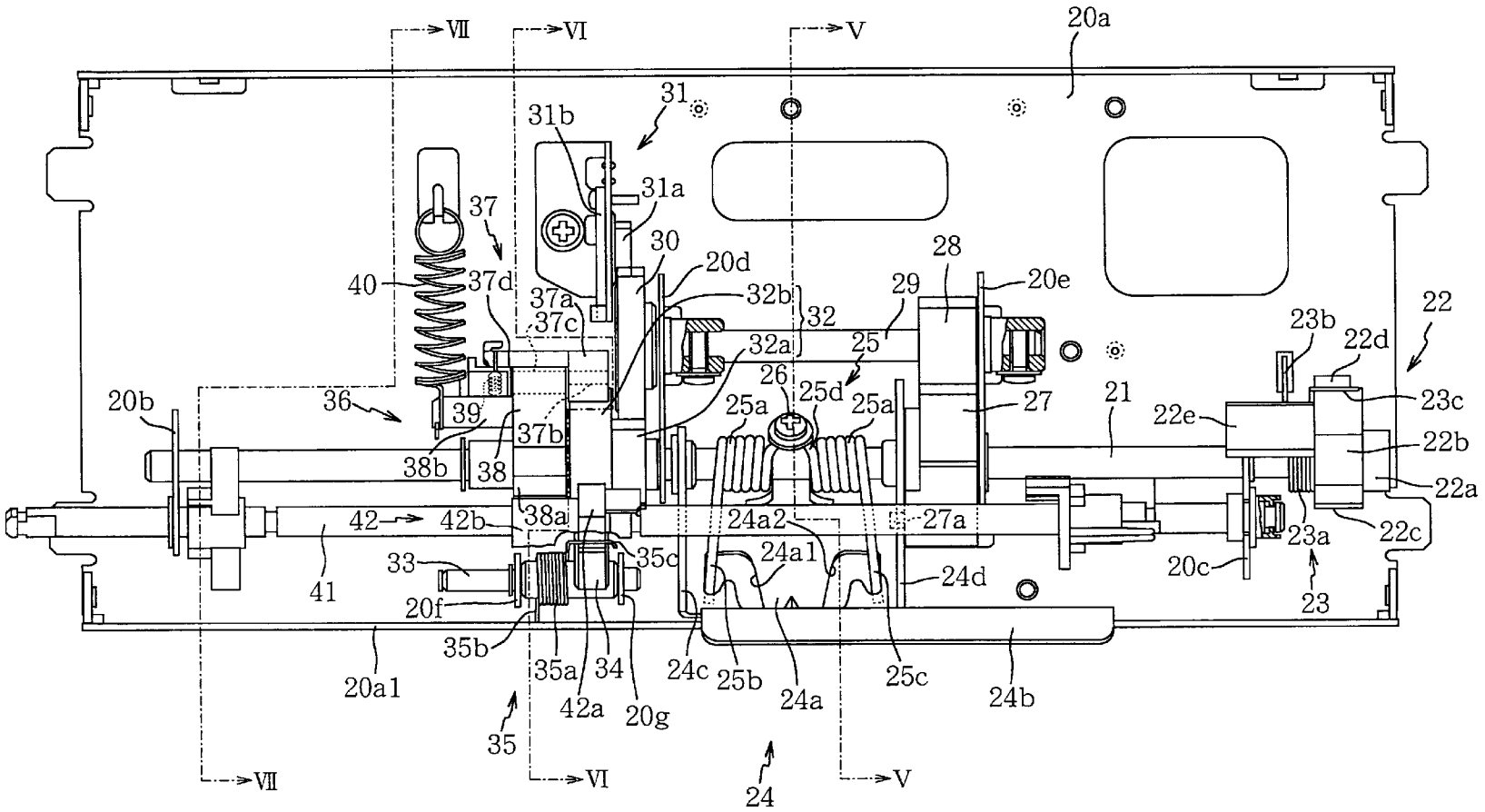
FIG. 3 is a front view of a pushing device.

Referring now to FIG. 3, the pushing device 20 will be described in detail. FIG. 3 is a front view of the pushing device 20. The right side in FIG. 3 corresponds to the side far away from the reader in FIG. 1, and the left side corresponds to the side toward the reader. The gear teeth of a driving gear 27, a first sub-gear 28, a second sub-gear 30, a transfer gear 31*a* of an attenuator 31, and a gear teeth portion 32*a* of a ratchet gear 32 are omitted from FIG. 3.

As shown in FIG. 3, the pushing device 20 includes a frame 20*a* bent by pressing a metal plate. On both lower sides (right and left sides in FIG. 3) of the frame 20*a*, substantially flat ribs 20*b*, 20*d*, 20*e*, 20*c* extend frontward (toward the reader in FIG. 3). A main shaft 21, which is substantially a round bar, is rotatably supported by the ribs 20*d*, 20*c*. Also, the main shaft 21 is prevented, by ribs 20*b*,

20*e*, from bending. The urging arm 22 pushed by the push-up plate 4*f* of the sheet feed cassette 4 is fixedly mounted to one end (on the right side in FIG. 3) of the main shaft 21. On the left side of the urging arm 22, an elastic spring 23 is disposed to urge the urging arm 22 downward.

Figure 4:
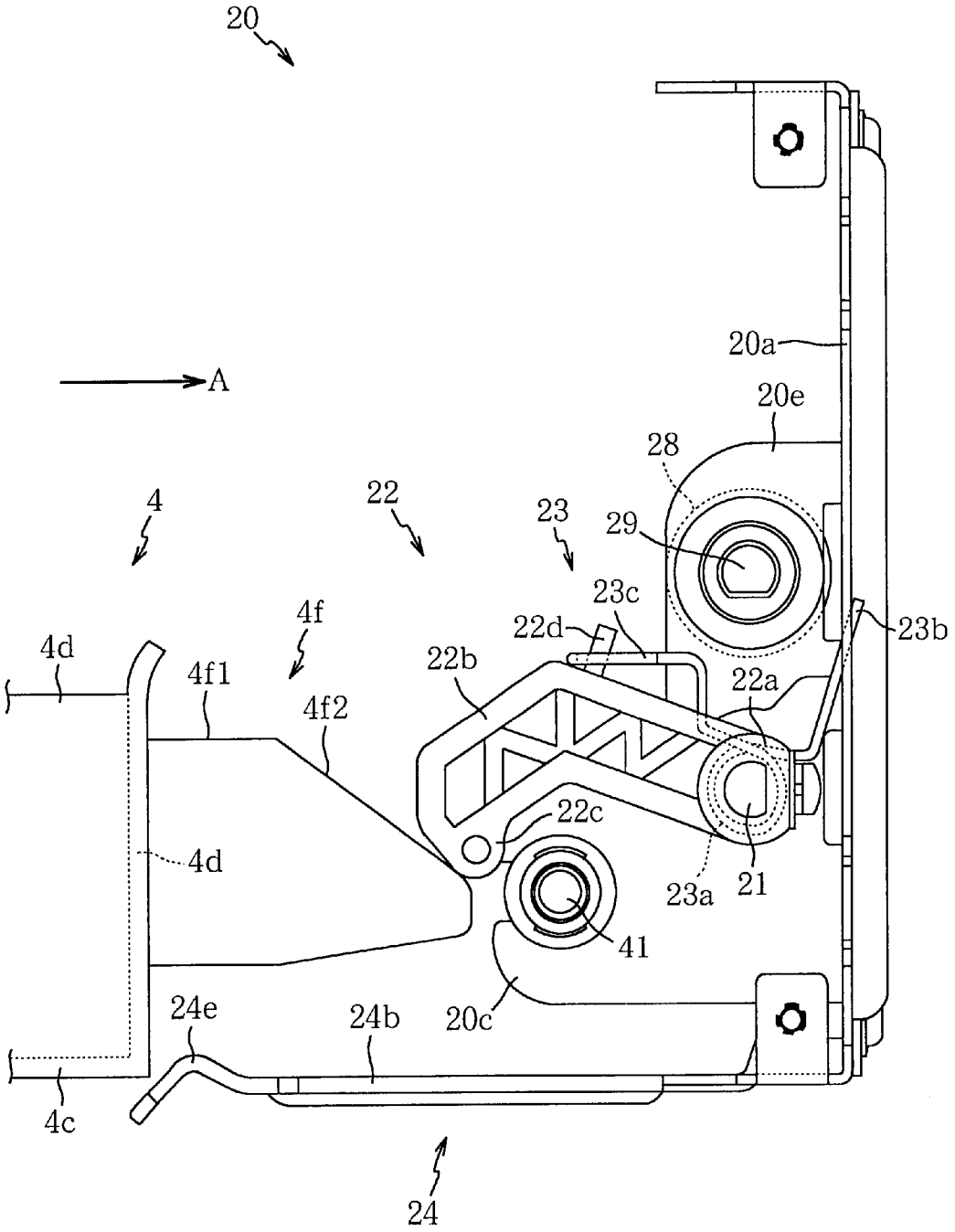
FIG. 4 is a right side sectional view of the pushing device of FIG. 3.

Referring now to FIG. 4, the push-up plate 4*f* of the sheet feed cassette 4 and the elastic spring 23 of the urging arm 22 will be described in detail. FIG. 4 is a right side sectional view of the pushing device 20 of FIG. 3, with the sheet feed cassette 4 partially removed. Arrow A in FIG. 4 indicates the direction in which the sheet feed cassette 4 is inserted. As shown in FIG. 4, the push-up plate 4*f* of the sheet feed cassette 4 has a substantially horizontal engaging surface 4*f*1 at its upper end, and a guide surface 4*f*2 tilted down from one end (on the right side in FIG. 4) of the engaging surface 4*f*1 to the tip (on the right side in FIG. 4) of the push-up plate 4*f*.

The urging arm 22 has a circular boss 22*a* at its one end (on the right side in FIG. 4), and the main shaft 21 is fixedly mounted into the boss 22*a*. An inverted V-shaped arm portion 22*b* extends from the circumference of the boss 22*a* toward the side (left side in FIG. 4) away from the frame 20*a*. At the end opposite to the boss 22*a*, the arm portion 22*b* has a downwardly extending protrusion 22*c*, which is semicircular as viewed from the side. The protrusion 22*c* is formed so as to make contact with the push-up plate 4*f* of the sheet feed cassette 4. The lower surface of the protrusion 22*c* makes contact with the guide surface 4*f*2 of the push-up plate 4*f*.

The arm portion 22*b* has a substantially flat engaging protrusion 22*d* at its upper portion. The engaging protrusion 22*d* engages the extending hook 23*c* of the elastic spring 23. The elastic spring 23 urges the arm portion 22*b* counterclockwise about the main shaft 21, thereby urging the urging arm 22 downward. The elastic spring 23 is formed by winding a wire having restorable elasticity (an elastic material).

The elastic spring 23 includes a coil 23*a*, an extending portion 23*b* that extends from one end (left side in FIG. 3) of the coil 23*a*, and the extending hook 23*c* that extends from the other end (right side in FIG. 3) of the coil 23*a*. As shown in FIG. 4, the main shaft 21 is inserted through the coil 23*a*. The extending portion 23*b* engages the frame 20*a*, while the extending hook 23*a* engages the engaging protrusion 22*d* of the urging arm 22.

When the sheet feed cassette 4 is removed from the cassette inserting section 1*b*, the elastic spring 23 urges the urging arm 22 counterclockwise about the main shaft 21. As a result, the main shaft 21 is rotated counterclockwise, and, upon the counterclockwise rotation of the main shaft 21, the push plate 24 is reliably lowered to its lower position (as shown in FIG. 1).

On the other hand, when the sheet feed cassette 4 is inserted in the direction of arrow A, the guide surface 4*f*2 of the push-up plate 4*f* makes contact with the protrusion 22*c*, and the protrusion 22*c* slides upward over the guide surface 4*f*2. When the protrusion 22*c* is pushed up, the urging arm 22 urged by the elastic spring 23 swings clockwise about the main shaft 21. At this time, upon the clockwise swing of the urging arm 22, the main shaft 21 is rotated clockwise.

As the main shaft 21 is rotated, the elastic spring 25 for urging the push plate 24 is elastically distorted, as described later, and a force for urging the push plate 24 is built up in the elastic spring 25. In addition, the urging arm 22 is urged counterclockwise about the main shaft 21 by the elastic spring 23 as well as by an urging force built up in the elastic spring 25.

After that, as the sheet feed cassette 4 continues to be inserted, the protrusion 22*c* reaches the engaging surface 4*f*1, past the guide surface 4*f*2, and is pressed against the engaging surface 4*f*1 by urging forces of the elastic springs 23, 25. As a result, the sheet feed cassette 4 is engaged in the cassette inserting section 1*b* so as not to be easily removed from the cassette inserting section 1*b*. So long as the sheet feed cassette 4 is kept inserted into the cassette inserting section 1*b*, the urging arm 22 is kept pushed up by the push-up plate 4*f*, thereby allowing the elastic spring 25 to build up an urging force.

Referring back to FIG. 3, a stopper 22*e* extends outward (leftward in FIG. 3) from the left side of the arm portion 22*b* of the urging arm 22. The stopper 22*e* is in contact with the upper end of the rib 20*c* and restricts the downward swing of the downwardly-urged urging arm 22. Thus, when the sheet feed cassette 4 is removed from the cassette inserting section 1*b*, the urging arm 22 is positioned to a predetermined position, as shown in FIG. 4.

As shown in FIG. 3, the push plate 24 is disposed at a substantially central part in the axial direction (right/left direction in FIG. 3) of the main shaft 21. The push plate 24 vertically moves the pressure plate 6 and includes a plate-like base 24*a* that extends downward from the main shaft 21, a plate-like push portion 24*b* that extends forward (toward the reader in FIG. 3) horizontally from the base 24*a*, and substantially flat support plates 24*c*, 24*d*. The main shaft 21 is rotatably inserted through the support plates 24*c*, 24*d*. The main shaft 21 and the push plate 24 are linked by the support plates 24*c*, 24*d* through a bearing and a driving gear 27.

In addition, the elastic spring 25 is attached to the main shaft 21 to apply an upward urging force to the push plate 24. The elastic spring 25 is formed by winding a wire having restorable elasticity (an elastic material) and includes a cylindrically wound coil 25*a*, a pair of extending portions 25*b*, 25*c* that extend from both sides (right and left sides in FIG. 3) of the coil 25*a*, and a hook 25*d* provided at a substantially central part in the longitudinal direction (right/left direction in FIG. 3) of the coil 25*a*.

Figure 5:
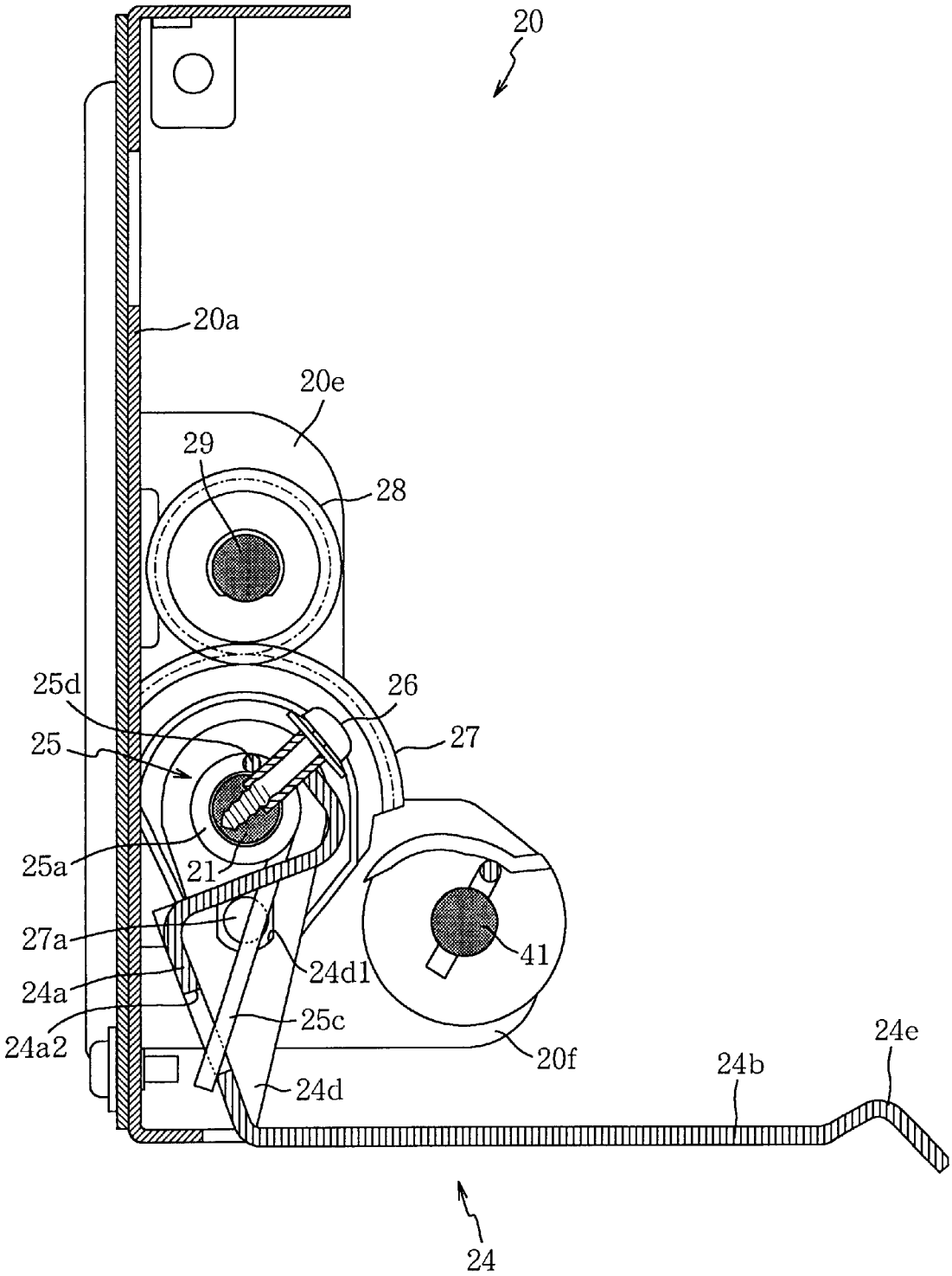
FIG. 5 is a side sectional view taken along line V—V of FIG. 3.

The coil 25*a* of the elastic spring 25 is interposed between the support plates 24*c*, 24*d* of the push plate 24, and the main shaft 21 is inserted through the coil 25*a* (FIG. 5). The extending portions 25*b*, 25*c* are engaged in holes 24*a*1, 24*a*2 provided in the base 24*a*. The hook 25*d* is hooked over a screw 26 screwed into the circumference of the main shaft 21.

The driving gear 27 is disposed adjacent to and on the right side of the support plate 24*d* of the push plate 24. The driving gear 27 is a gear wheel rotated in response to the vertical movement of the push plate 24 and has a plurality of gear teeth on its circumference. A substantially cylindrical boss 27*a* is provided so as to extend toward the support plate 24*d* from a lower portion of the driving gear 27. The boss 27*a* is engaged in a hole 24*d*1 drilled through the support plate 24*d* (FIG. 5). Thus, the driving gear 27 can be rotated as the push plate 24 vertically moves.

A first sub-gear 28 is disposed above the driving gear 27. The first sub-gear 28 is rotated by the rotation of the driving gear 27 and has, on its circumference, gear teeth that mesh with the gear teeth of the driving gear 27. The first sub-gear 28 is fixedly attached to one end (on the right side in FIG. 3) of a driven shaft 29 disposed in substantially parallel with the main shaft 21. The driven shaft 29 is rotatable by the rotation of the first sub-gear 28. Also, the driven shaft 29 is rotatably supported at its both ends (right and left sides in FIG. 3) by the flat ribs 20*d*, 20*e* that extend frontward (toward the reader in FIG. 3) from the frame 20*a*.

Referring now to FIG. 5, the push plate 24, the elastic spring 25, the screw 26, the driving gear 27, the first sub-gear 28, and the driven shaft 29 will be described in detail. FIG. 5 is a side sectional view taken along line V—V of FIG. 3, with the respective circumferential gear teeth of the driving gear 27 and the first sub-gear 28 omitted. The pitch circles of the driving gear 27 and the first sub-gear 28 are shown by long and short dashed lines, while their addendum circles and bottom circles are shown by solid lines.

As shown in FIG. 5, the base 24*a* of the push plate 24 is bent into Z shape as viewed from the side. At the lower portion of the base 24*a*, the hole 24*a*2 is formed through the plate of the base 24*a*. The extending portion 25*c* of the elastic spring 25 is inserted into the hole 24*a*2 and engaged with the lower edge of the hole 24*a*2. By the engagement of the extending portion 25*c* (and the extending portion 25*b*) of the elastic spring 25 with the base 24*a* of the push plate 24, the base 24*a* is urged counterclockwise in FIG. 5 about the main shaft 21, thereby moving upward the push plate 24.

The substantially flat push portion 24*b* is formed continuously from the lower end of the base 24*a*. The push portion 24*b* extends from the base 24*a* substantially horizontally toward the direction (rightward in FIG. 5) away from the frame 20*a*. The inverted V-shaped contact 24*e* is formed at the leading edge of the push portion 24*b*. The contact 24*e* projects upward and makes contact, at its top, with the lower surface of the pressure plate 6 (FIG. 1).

The elastic spring 25 is provided such that the coil 25*a* is wounded around the main shaft 21 and the hook 25*d* is hooked over the screw 26 screwed into the main shaft 21. Thus, when the main shaft 21 is rotated (counterclockwise in FIG. 5), the screw 26 swings counterclockwise and the hook 25*d* is moved up counterclockwise about the main shaft 21. As a result, the coil 25*a* of the elastic spring 25 is elastically distorted. An elastic restoring force built up in the elastic spring 25*c* due to such distortion is generated from the extending portions 25*b*, 25*c* as upward urging forces.

The hole 24*d*1 is formed in the support plate 24*d* of the push plate 24, and the boss 27*a*, projecting from the driving gear 27, is engaged in the hole 24*d*1. The drive gear 27 has gear teeth on its circumference, and the gear teeth of the first sub-gear 28 mesh therewith. The first sub-gear 28 has gear teeth on its circumference, and the driven shaft 29 is fixedly attached to the center of the first sub-gear 28.

Referring back to FIG. 3, the second sub-gear 30 is fixedly attached to the other end (on the left side in FIG. 3) of the driven shaft 29. The second sub-gear 30 is a gear wheel rotated by the rotation of the driven shaft 29 and has gear teeth on its circumference. The attenuator 31 is disposed above the second sub-gear 30. The attenuator 31 is a rotary damper for attenuating the rotation speed of the second sub-gear 30 and includes the transfer gear 31*a* for transferring a rotating force of the second sub-gear 30 and a case 31*b* filled with a viscous material.

The transfer gear 31*a* has, on its circumference, gear teeth that mesh with the gear teeth of the second sub-gear 30 to transfer the rotation of the second sub-gear 30. The transfer gear 31*a* is linked to an impeller wheel (not shown) housed in the case 31*b*, and as the transfer gear 31*a* rotates, the impeller wheel rotates. Because the impeller wheel rotates within the case 31*b* filled with the viscous material, such as grease, the rotation speed of the second sub-gear 30 is attenuated.

By attenuating the rotation speed of the second sub-gear 30, the rotation speed of the driving gear 27 is attenuated through the driven shaft 29 and the first sub-gear 28. Thus, the speed at which the push plate 24 vertically moves as the drive gear 27 rotates is attenuated. Particularly, the moving up speed of the push plate 24 when urged by the elastic spring 25 is attenuated.

The ratchet gear 32 is disposed below the second sub-gear 30 and includes the gear teeth portion 32*a* for receiving the rotation of the second sub-gear 30 and a ratchet pawl portion 32*b*. The gear teeth portion 32*a* is substantially cylindrical and has, on its circumference, gear teeth that mesh with the gear teeth of the second sub-gear 30. On the left side of the gear teeth portion 32*a*, the ratchet pawl portion 32*b* having a larger outside diameter than the gear teeth portion 32*a* is formed integrally with the gear teeth portion 32*a*.

A lock shaft 33, which is substantially a round bar, is disposed below the ratchet gear 32. The lock shaft 33 is rotatably supported at its both ends (on the right and left sides in FIG. 3) by substantially flat ribs 20*f*, 20*g* extending from the frame 20*a*. The lock shaft 33 supports a lock 34 extending toward the ratchet pawl portion 32*b* of the ratchet gear 32. The lock 34 restricts the forward rotation (counterclockwise rotation indicated by arrow B in FIG. 6) of the ratchet gear 32 and permits the reverse rotation (clockwise rotation in FIG. 6) thereof. The lock shaft 33 is inserted through the lower end of the lock 34, and an elastic spring 35 is disposed on the left side of the lock 34 to urge the lock 34 upward.

Figure 6:
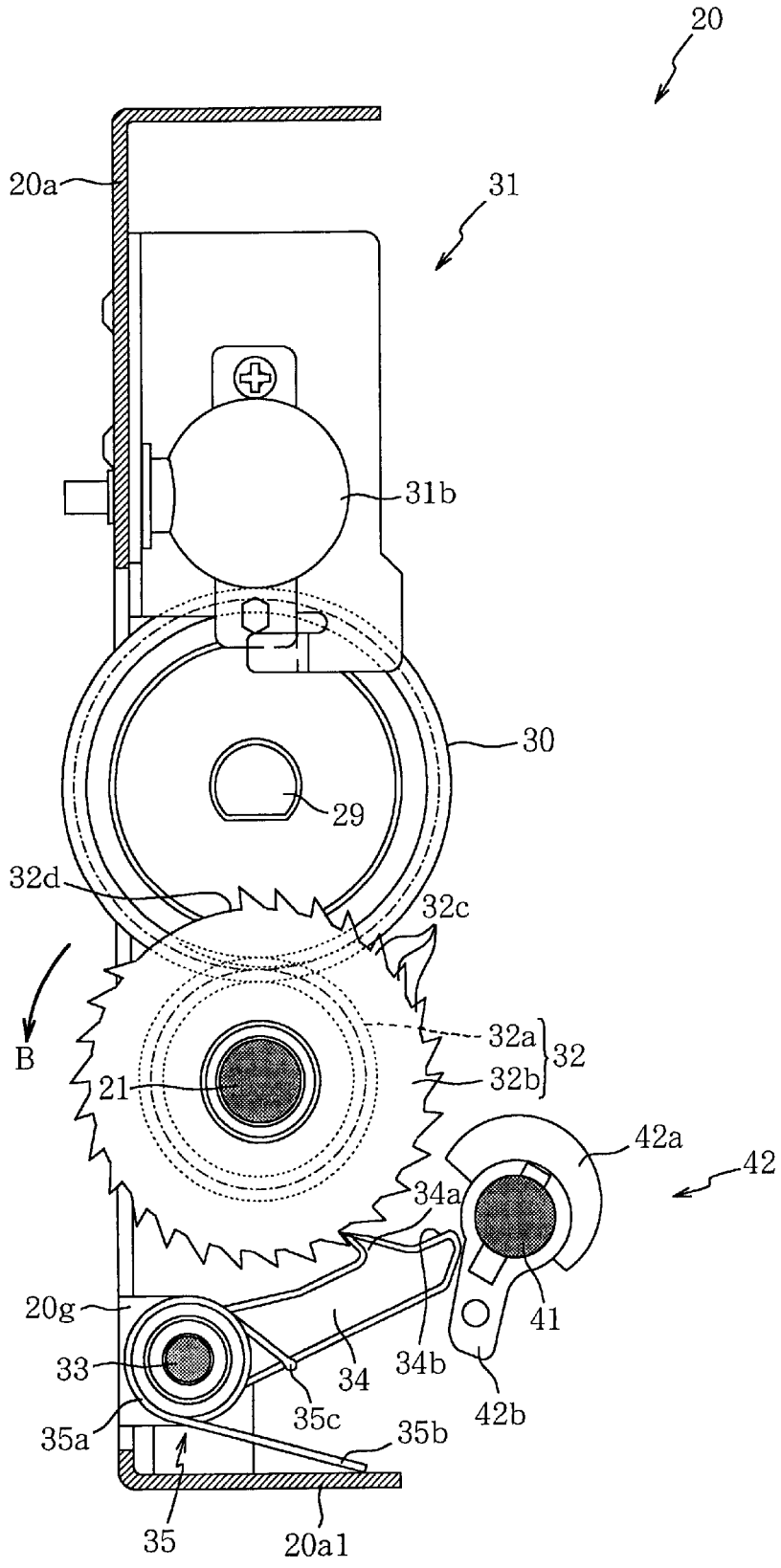
FIG. 6 is a side sectional view taken along line VI—VI of FIG. 3.

Referring now to FIG. 6, the second sub-gear 30, the ratchet gear 32, the lock shaft 33, the lock 34, and an elastic spring 35 will be described in detail. FIG. 6 is a side sectional view taken along line VI—VI of FIG. 3, with the circumferential gear teeth of the second sub-gear 30 and the circumferential gear teeth of the gear teeth portion 32*a* of the ratchet gear 32 omitted. The pitch circles of the second sub-gear 30 and the gear teeth portion 32*a* are shown by alternate long and short dashed lines, while their addendum circles and bottom circles are shown by broken lines. Arrow B indicates the (forward) direction in which the ratchet gear 32 rotates as the push plate 24 moves up.

As shown in FIG. 6, the driven shaft 29 is disposed at a substantially central part in the vertical direction of the frame 20*a*. The second sub-gear 30 is fixedly attached to the driven shaft 29. The second sub-gear 30 has gear teeth on its entire circumference. The attenuator disposed above the second sub-gear 30 is screw-fastened to the frame 20*a*. On the other hand, the ratchet gear 32 is disposed below the second sub-gear 30.

The ratchet gear 32 includes the gear teeth portion 32*a* (on the side away from you in FIG. 6) and the ratchet pawl portion 32*b* (on the side toward you in FIG. 6). The main shaft 21 is rotatably inserted through the central parts of the gear teeth portion 32*a* and the ratchet pawl portion 32*b*. The gear teeth portion 32*a* has, on its entire circumference, gear teeth that mesh with the gear teeth of the second sub-gear 30. Thus, the second sub-gear 30 can transfer the rotation of the ratchet gear 32, and vice versa.

The ratchet pawl portion 32*b* of the ratchet gear 32 is integrally formed with the gear teeth portion 32*a* and has substantially acute ratchet pawls 32*c* at predetermined intervals on its circumference. A lock pawl 34*a* of the lock 34 is engageable with a recess between the consecutive ratchet pawls 32*c*. At a lower portion of the ratchet pawl portion 32*b*, the lock pawl 34*a* is engaged with a recess between the consecutive ratchet pawls 32*c*. At an upper portion, near the frame 20*a* (on the left side in FIG. 6), of the ratchet pawl portion 32*b*, a ratchet pawl-absent portion 32*d*, which will be described later, is formed.

The lock 34 is disposed below the ratchet gear 32. The lock shaft 33 is inserted through one end (on the left side in FIG. 6) of the lock 34. The lock 34 extends from the lock shaft inserting section upward away from the frame 20*a* (toward the upper right in FIG. 6). The acute lock pawl 34*a* projects from the upper surface at the extending end of the lock 34 toward the ratchet pawl portion 32*b* so as to engage with the ratchet pawl 32*c*.

When the lock pawl 34*a* is engaged with a ratchet pawl 32*c*, the lock pawl 34*a* restricts the counterclockwise rotation (forward rotation indicated by arrow B in FIG. 6) of the ratchet gear 32, and permits the clockwise rotation (reverse rotation opposite to the direction of arrow B in FIG. 6) thereof. When the lock pawl 34*a* is released from engagement with the ratchet pawl 32*c*, the ratchet gear 32 is rotatable in either direction, counterclockwise or clockwise in FIG. 6.

The rotation of the ratchet gear 32 in the direction of arrow B (counterclockwise rotation in FIG. 6) is referred to as "forward rotation", and the rotation of the ratchet gear 32 in the direction opposite to arrow B (clockwise rotation in FIG. 6) as "reverse rotation" hereinafter.

The lock 34 has a pushed-down portion 34*b* disposed at the extending end (on the upper right side in FIG. 6) beyond the lock pawl 34*a*. The pushed-down portion 34*b* is pushed down by a release cam 42*a* of a coupled cam 42 at predetermined times, as described later. When the pushed-down portion 34*b* is pushed down, the lock 34 swings clockwise in FIG. 6 about the lock shaft 33, thereby releasing the lock pawl 34*a* from engagement with the ratchet pawl 32*c*.

A coil 35*a* of an elastic spring 35 is wounded around the lock shaft 33 inserted through the lock 34. The elastic spring 35, formed by winding a wire having restorable elasticity, urges the lock 34 toward the ratchet pawl portion 32*b* (upward in FIG. 6). The elastic spring 35 includes the cylindrically wound coil 35*a*, an extending portion 35*b* that extends from one end (on the left side in FIG. 6) of the coil 35*a*, and an extending hook 35*c* that extends from the other end (on the right side in FIG. 6) of the coil 35*a*.

As shown in FIG. 6, the lock shaft 33 is inserted through the coil 35*a*. The extending portion 35*b* is pressed against a base plate 20*a*1 that extends substantially horizontally from the lower end of the frame 20*a*, while the extending hook 35*c* is engaged with the lower surface of the lock 34. Thus, the lock 34 is urged counterclockwise in FIG. 6 about the lock shaft 33, thereby pushing the lock pawl 34*a* against the ratchet pawl 32*b* to bring them into secure engagement with each other.

Referring back to FIG. 3, a lowering mechanism 36 is disposed on the opposite side (on the left side in FIG. 3) of the ratchet gear 32 from the push plate 24. The lowering mechanism 36 lowers the push plate 24 by a predetermined distance from a position where a stack of sheets P on the pressure plate 6 is in contact with the sheet feed roller 7 (FIG. 9) to a position where a stack of sheets P on the pressure plate 7 is away from the sheet feed roller 7 (FIG. 10).

Figure 9:
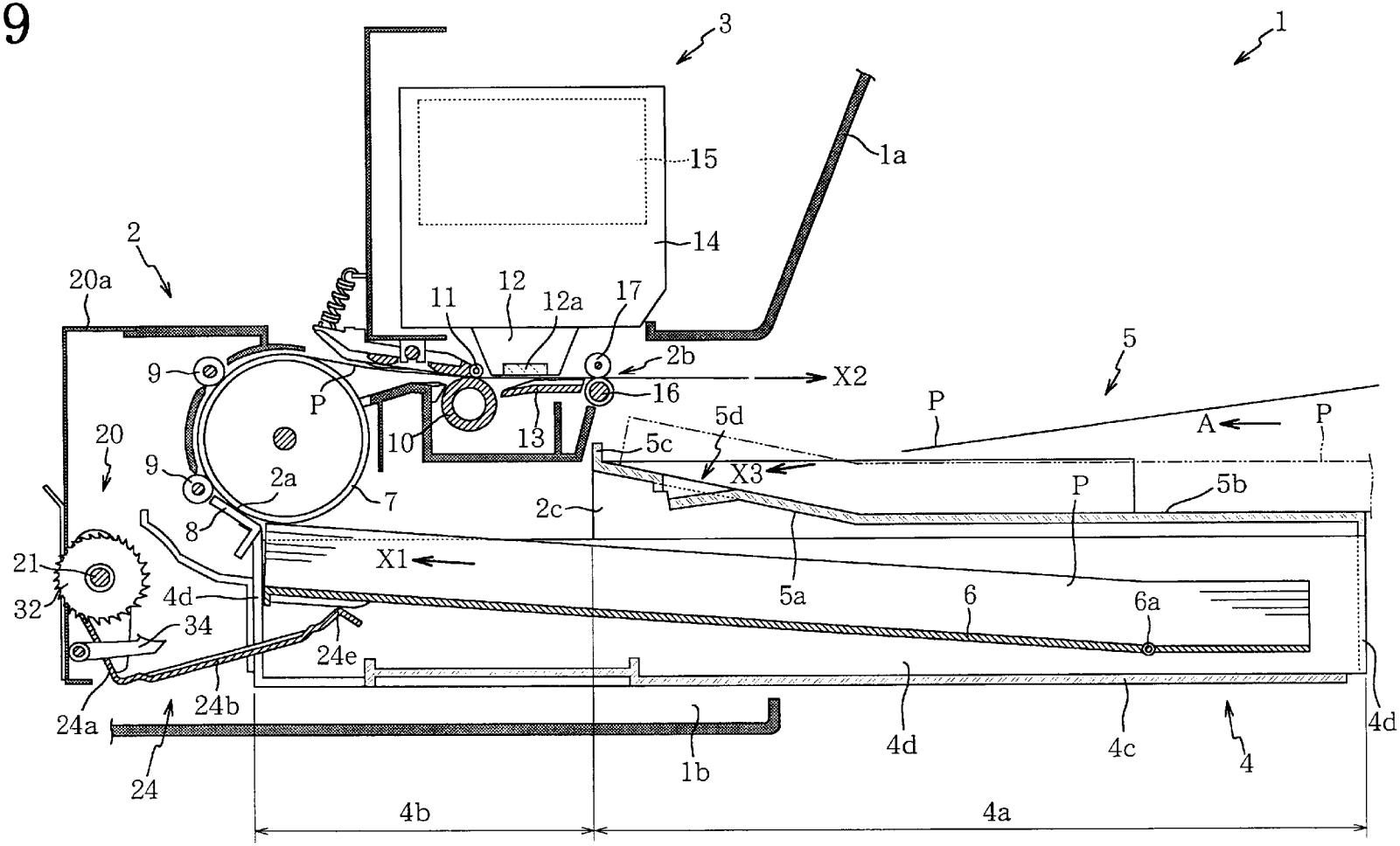
FIG. 9 is a side sectional view showing the internal structure of the printer, with a push plate at its upper position.
Figure 10:
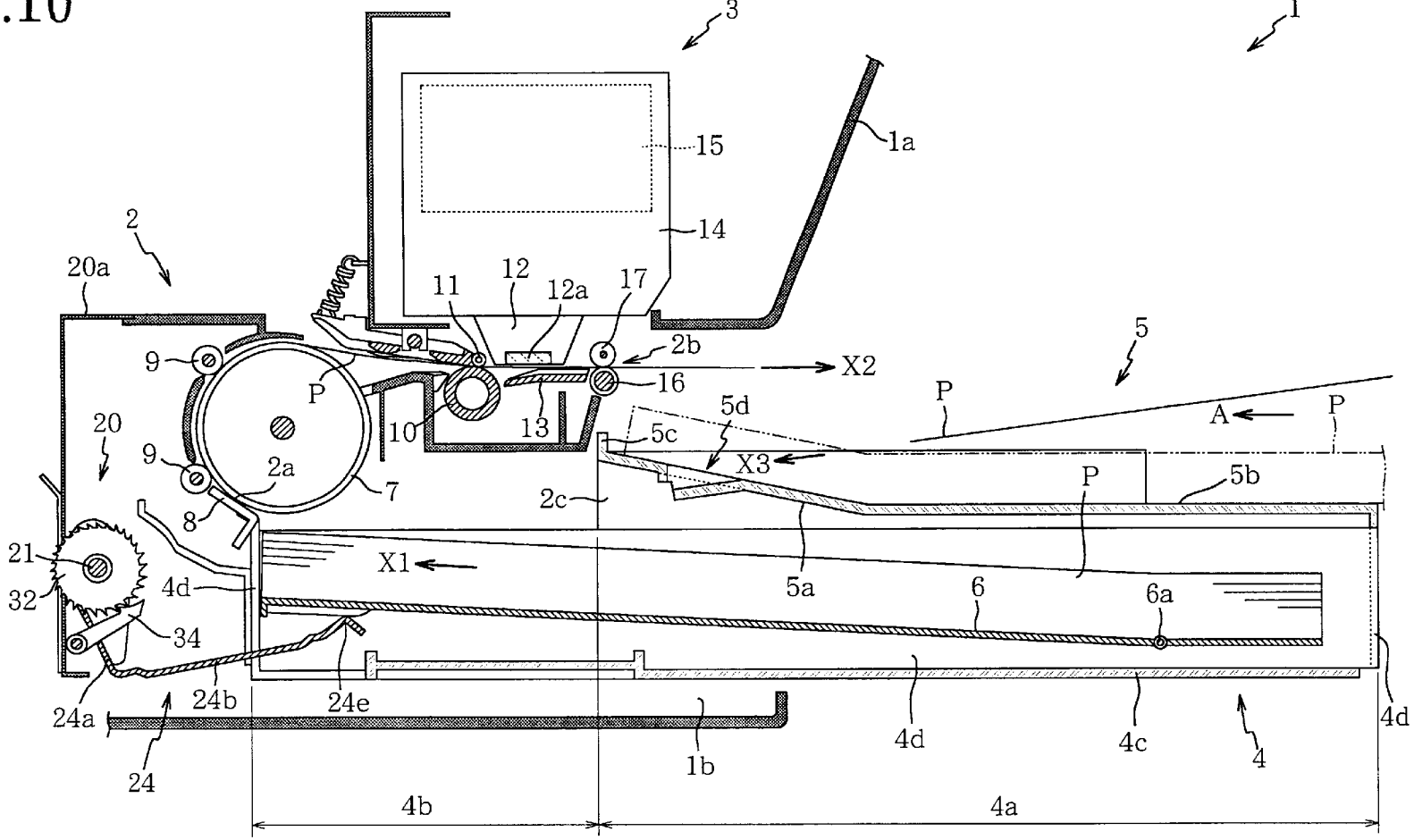
FIG. 10 is a side sectional view showing the internal structure of the printer, with the push plate at its standby position.

The position of the push plate 24 when a stack of sheets P is in contact with the sheet feed roller 7 (as shown in FIG. 9) is referred to as a "plate upper position" hereinafter. On the other hand, the position of the push plate 24 when the pressure plate 6 is placed substantially horizontally, adjacent to the bottom plate 4*c* of the sheet feed cassette 4, while the stack of sheets P is greatly away from the sheet feed roller 7 (as shown in FIG. 1) is referred to as a "plate lower position". Further, the position of the push plate 24 when a stack of sheets P is away from the sheet feed roller 7 by a predetermined distance (as shown in FIG. 10) is referred to as a "plate standby position".

The lowering mechanism 36 includes the above-described ratchet pawl portion 32*b* of the ratchet gear 32, an engaging member 37 that engages the ratchet pawl portion 32*b* to rotate in reverse the ratchet gear 32, an actuating member 38 that transfers a force for rotating in reverse the ratchet gear 32 to the engaging member 37, and two elastic springs 39, 40 for urging the engaging member 37 and the actuating member 38, respectively.

The engaging member 37 is interposed between the second sub-gear 30 and the actuating member 38 and includes a movable arm 37*a*, disposed above the ratchet pawl portion 32*b* of the ratchet gear 32, and an engaging pawl 37*b* engageable with the ratchet pawl 32*c*. A connecting shaft 37*c* extends from one side (left side in FIG. 3) of the movable arm 37*a* to the actuating member 38 and is connected to the actuating member 38 such that the actuating member 38 swings. Above the connecting shaft 37*c*, a spring-holding arm 37*d* extends in the same direction (leftward in FIG. 3) in which the connecting shaft 37*c* extends. The upper end of the elastic spring 39 is hooked over the spring-holding arm 37*d*.

The actuating member 38 is disposed adjacent to (on the left side in FIG. 3) the ratchet pawl portion 32*b* and includes a pushed-down portion 38*a* to be pushed down by a push-down cam 42*b* of the coupled cam 42, which will be described later, and a spring-holding arm 38*b* over which the lower end of the elastic spring 40 is hooked.

Figure 7:
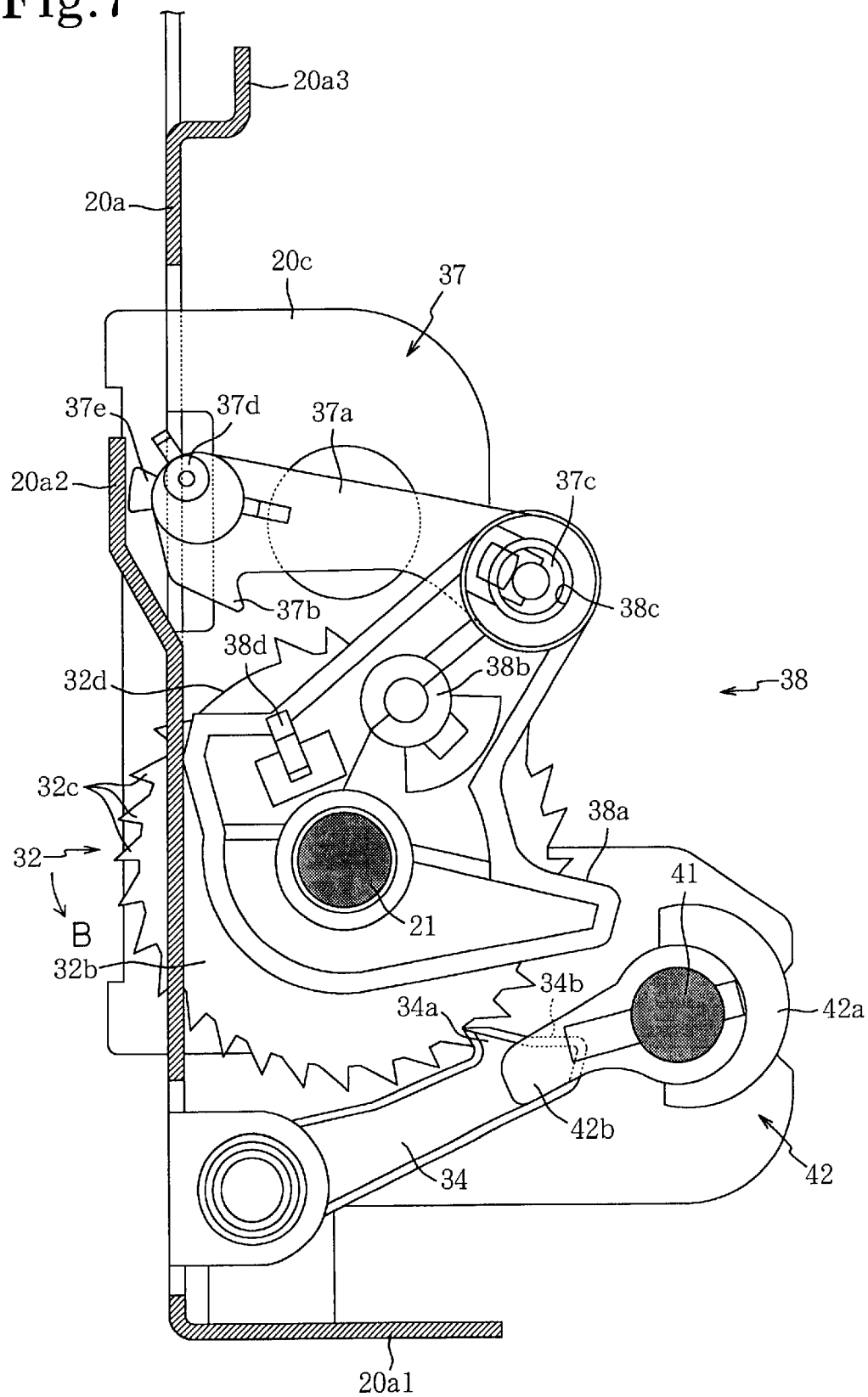
FIG. 7 is a side sectional view of a lowering mechanism.
Figure 8:
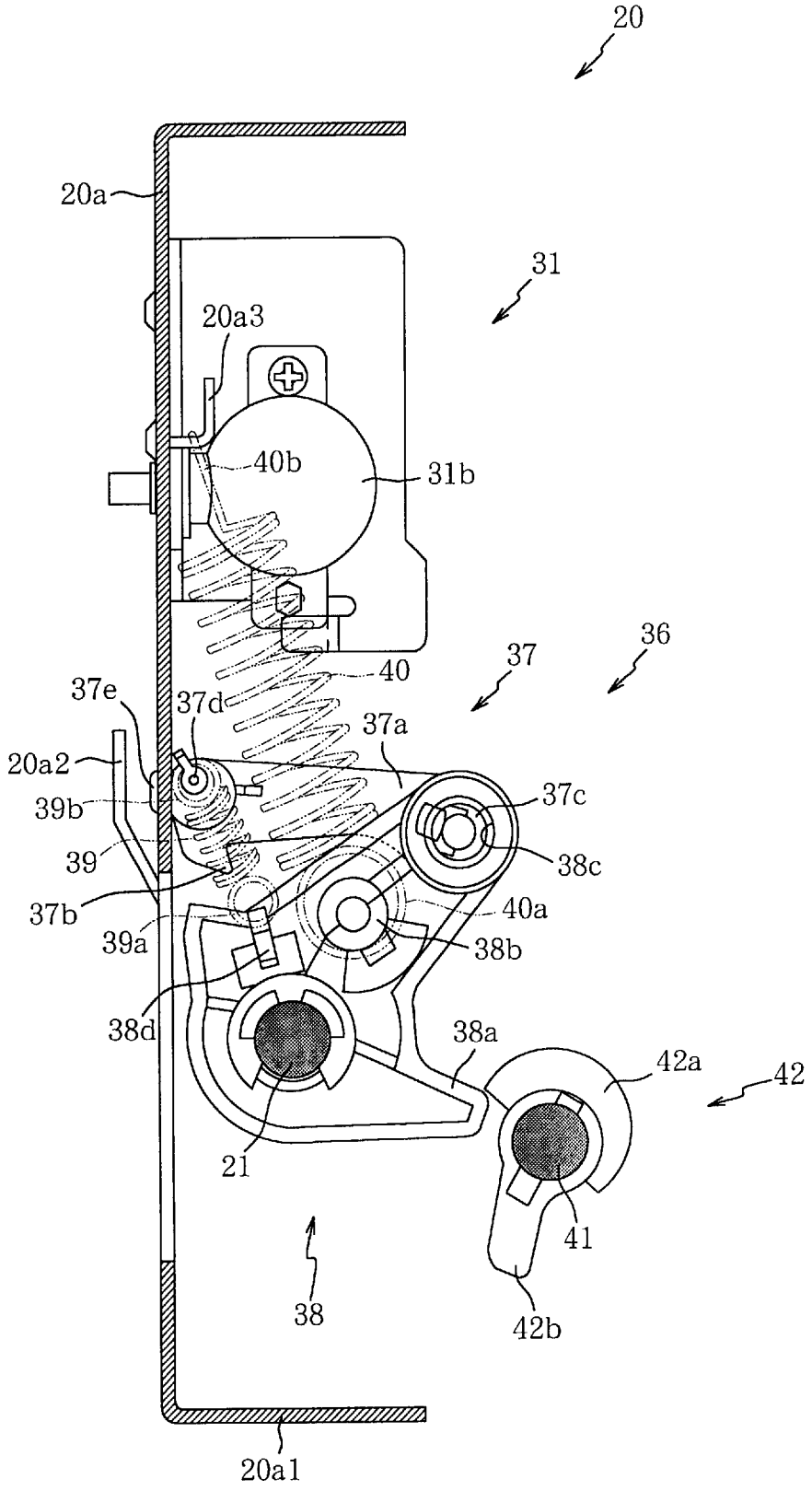
FIG. 8 is a side sectional view taken along line VII—VII of FIG. 3.

Referring now to FIGS. 7 and 8, the lowering mechanism 36 will be described in detail. FIG. 7 is a side sectional view of the lowering mechanism 36, with the elastic springs 39, 40 omitted.

As shown in FIG. 7, the engaging member 37 rotates in reverse (in the clockwise direction in FIG. 7, in the direction opposite to arrow B in FIG. 7) the ratchet gear 32 to lower the push plate 24 and includes the movable arm 37*a* having an inverted V-shape as viewed from the side. The movable arm 37*a* is slightly tilted down from one end near the frame 20*a* to the other end away from the frame 20*a*. The acute engaging pawl 37*b* projects downward from one end (on the left side in FIG. 7) of the movable arm 37*a*. The engaging pawl 37*b* is engageable with the ratchet pawl 32*c* of the ratchet pawl portion 32*b* disposed below the engaging member 37.

The connecting shaft 37*c* is provided on the other end (on the right side in FIG. 7) of the movable arm 37*a* and is connected to a connecting hole 38*c* formed at an upper portion of the actuating member 38 such that the actuating member swings. The spring-holding arm 37*d* is provided at an upper portion on the engaging pawl side (left side in FIG. 7) of the movable arm 37*a*. The upper end of the elastic spring 39 is hooked over the spring-holding arm 37*d*. A stopper 37*e*, which is substantially rectangular as viewed from the side, projects from the end formed with the engaging pawl 37*b* (on the left side in FIG. 7) toward the frame 20*a* (leftward in FIG. 7). The stopper 37*e* makes contact with a stopper plate 20*a*2 provided to the frame 20*a*, thereby restricting the movement of the engaging member 37 toward the frame 20*a* (leftward in FIG. 7).

The ratchet pawl-absent portion 32*d*, which lacks, for example, three ratchet pawls 32*c*, is provided so as to oppose the engaging pawl 37*b* of the engaging member 37. Thus, when the push plate 24 is at the plate lower position, the engaging pawl 37*b* is not allowed to engage the ratchet pawl-absent portion 32*d*. Thus, the push plate 24 is prevented from being lowered below the plate lower position. As a result, the pushing device 20 is prevented from breaking down due to excessive lowering of the push plate 24.

The main shaft 21 is rotatably inserted in the actuating member 38. The pushed-down portion 38*a* extends from the main shaft-inserting portion downward away from the frame 20*a* (toward the lower right in FIG. 7). The pushed-down portion 38*a* is pushed down by the push-down cam 42*b* of the coupled cam 42 at predetermined times, as described later. Subsequently, the actuating member 38 swings clockwise about the main shaft 21.

The spring-holding arm 38*b* is disposed above the main shaft-inserting portion and slightly closer to the pushed-down portion 38*a* (on the right side in FIG. 7). A substantially ring-shaped hook 40*a* at the lower end of the elastic spring 40 is hooked over the spring-holding arm 38*b* (FIG. 8). Also, a spring-holding hook 38*d* is provided above the main shaft-inserting portion of the actuating member 38. A substantially ring-shaped hook 39*a* at the lower end of the elastic spring 39 is hooked over the spring-holding hook 38*d* (FIG. 8).

FIG. 8 is a side sectional view taken along line VII—VII of FIG. 3. The elastic springs 39, 40 are shown by alternate long and two short dashed lines.

The elastic spring 39 is formed by winding a wire having restorable elasticity to urge the end formed with the engaging pawl 37*b* toward the actuating member 38. The substantially ring-shaped hook 39*a* formed at the lower end of the elastic spring 39 is hooked over the spring-holding hook 38*d* of the actuating member 38. Also, the substantially ring-shaped hook 39*b* formed at the upper end of the elastic spring 39 is hooked over the spring-holding arm 37*d* of the engaging member 37. Thus, the end formed with the engaging pawl 37*b* is urged toward the actuating member 38.

The elastic spring 40 is formed by winding a wire having restorable elasticity to urge the actuating member 38 upward (counterclockwise in FIG. 8) about the main shaft 21. The substantially ring-shaped hook 40*a* formed at the lower end of the elastic spring 40 is hooked over the spring-holding arm 38*b* of the actuating member 38. Also, the substantially ring-shaped hook 40*b* formed at the upper end of the elastic spring 40 is hooked over a spring-holding hook 20*a*3 formed at an upper portion of the frame 20*a* above the actuating member 38. Thus, the actuating member 38 is urged by the elastic spring 40 upward (counterclockwise in FIG. 8) about the main shaft 21.

Referring back to FIG. 3, a drive shaft 41, which is substantially a round bar, is interposed between the main shaft 21 and the lock shaft 33. The drive shaft 41 is rotatably supported at its both ends (right and left sides in FIG. 3) by the substantially flat ribs 20*b*, 20*c* extending from the frame 20*a*. The drive shaft 41 is connected, at its one end (on the left side in FIG. 3), to a rotary shaft of the sheet feed roller 7 through a gear mechanism (not shown) so as to rotate unidirectionally (counterclockwise in FIG. 7) as the sheet feed roller 7 rotates.

The coupled cam 42 is fixedly mounted at an axially central portion of the drive shaft 41 so as to be opposed to the lock 34 and the actuating member 38. The coupled cam 42 includes the release cam 42*a* (on the right side in FIG. 3) opposed to the lock 34 and the push-down cam 42*b* (on the left side in FIG. 3) opposed to the pushed-down portion 38*a*. The release cam 42*a* and the push-down cam 42*b* are integrally formed.

Referring now to FIG. 7, the coupled cam 42 will be described in detail. As shown in FIG. 7, the drive shaft 41 is fixedly attached into the coupled cam 42 so as to allow the coupled cam 42 to rotate counterclockwise in FIG. 7.

The substantially semicircular release cam 42*a* is formed about half way around the coupled cam 42. The release cam 42*a* pushes down the pushed-down portion 34*b* of the lock 34 at predetermined times to release the lock pawl 34*a* of the lock 34 from engagement with the ratchet pawl 32*c* of the ratchet pawl portion 32*b*. While the drive shaft 41 makes a half-turn, the release cam 42*a* keeps pushing down the pushed-down portion 34*b* of the lock 34, thereby releasing the lock pawl 34*a* from engagement with the ratchet pawl 32*c*.

On the other hand, the push-down cam 42*b* extends outward from the side opposite to the release cam 42*a*. The push-down cam 42*b* pushes down the pushed-down portion 38*a* of the actuating member 38 at predetermined times to swing the actuating member 38 clockwise in FIG. 7 about the main shaft 21. While the drive shaft 41 rotates by a predetermined angle, the push-down cam 42 keeps pushing down the actuating member 38, thereby swinging the actuating member 38 clockwise in FIG. 7.

The sheet feed operation in the printer 1 having the sheet feeder 2 as structured above will now be described. FIG. 9 is a side sectional view showing the internal structure of the printer 1, with the push plate 24 at the plate upper position. FIG. 10 is a side sectional view showing the internal structure of the printer 1, with the push plate 24 at the standby position.

As shown in FIG. 1, a stack of sheets P to be printed are placed on the top surface of the pressure plate 6 in the sheet feed cassette 4. Then, the covered portion 4*a* of the open surface of the sheet feed cassette 4 is covered by the cassette cover 5. After that, upon the insertion of the sheet feed cassette 4 into the cassette inserting section 1*b*, an edge (on the left side in FIG. 1) of a stack of sheets P in the sheet feed cassette is placed below the sheet feed roller 7. Thereby, the sheet setting is completed.

On the other hand, as shown in FIG. 4, upon the insertion of the sheet feed cassette 4, the push-up plate 4*f* of the sheet feed cassette 4 approaches to the urging arm 22, and the guide surface 4*f*2 of the push-up plate 4*f* makes contact with the protrusion 22*c* of the urging arm 22.

After that, when the sheet feed cassette 4 continues to be inserted, the push-up plate 4*f* moves underneath the urging arm 22 in the direction of arrow A, thereby causing the protrusion 22*c* to slide up along the guide surface 4*f*2.

As the protrusion 22*c* slides up, the urging arm 22 swings upward (clockwise in FIG. 4) about the main shaft 21 against the urging force of the elastic spring 23. When the sheet feed cassette 4 still continues to be inserted, the protrusion 22*c* of the urging arm 22 reaches the engaging surface 4*f*1 of the push-up plate 4*f*, and the urging arm 22 presses the push-up plate 4*f*.

This pressing force maintains pressured contact of the urging arm 22 to the sheet feed cassette 4 and securely prevents the sheet feet cassette 4 from being removed from the cassette inserting section 1*b*.

As the urging arm 22 swings upward (clockwise in FIG. 4), the main shaft 21 is rotated counterclockwise in FIG. 5. This makes the screw 26 screwed into lie main shaft 21 swing counterclockwise in FIG. 5. By the swing of the screw 26, the hook 25*d* of the elastic spring 25 is moved up. As a result, the coil 25*a* of the elastic spring 25 is elastically distorted. An elastic restoring force is built up due to such distortion in the elastic spring 25 as a force for urging the push plate 24.

As described above, when the sheet feed cassette 4 is inserted and an urging force is built up in the elastic spring 25, the ratchet pawl 32*c* of the ratchet gear 32 is engaged with the lock pawl 34*a* of the lock 34, as shown in FIGS. 1, 6, and 7, Thus, the lock 34 restricts the rotation of the ratchet gear 32 in the forward direction (counterclockwise direction indicated by arrow B in FIGS. 6 and 7). This restriction further restricts the rotation of the second sub-gear 30 in mesh with the gear teeth portion 32*a* of the ratchet gear 32. As a result, the rotation of the driven shaft 29, the first sub-gear 28, and the driving gear 27 are restricted. By the rotation restriction on the driving gear 27, the push plate 24 engaged with the driving gear 27 through the boss 27*a* is halted at the plate lower position, as shown in FIG. 5, with the push portion 24*b* substantially horizontal.

If a sheet feed command is transmitted from a controller (not shown) when the sheet feed roller 7 rotates clockwise in FIG. 1 after the insertion of the sheet feed cassette 4, a lock lever (not shown) is released by a solenoid (not shown). As a result, the drive shaft 41 shown in FIGS. 6 to 8 is rotated counterclockwise through a gear mechanism (not shown), and then stopped by the lock lever.

The stopped drive shaft 41 is rotated again when another sheet feed command is transmitted again from the controller. In other words, the drive shaft 41 is rotationally driven intermittently upon receipt of a sheet feed command.

By the rotation of the drive shaft 41, the coupled cam 42 is rotated to bring the release cam 42*a* of the coupled cam 42 into contact with the pushed-down portion 34*b* of the lock 34. When the sheet feed roller 7 continues to rotate and the drive shaft 41 is further rotated, the release cam 42*a* pushes the pushed-down portion 34*b* of the lock 34. This makes the lock 34 swing down, against the urging force of the elastic spring 35, clockwise in FIGS. 6 to 8, about the lock shaft 33.

When the lock 34 swings down, the lock pawl 34*a* is released from the ratchet pawl 32*c*, and the lock 34 is released from the engagement with the ratchet gear 32. This allows the ratchet gear 32 to rotate about the main shaft 21. As a result, the second sub-gear 30 in mesh with the gear teeth portion 32*a* of the ratchet gear 32, the driven shaft 29, the first sub-gear 28, and the driving gear 27 are allowed to rotate.

Then, the extending portions 25*b*, 25*c* of the elastic spring 25 starts moving up by an elastic restoring force built up in the elastic spring 25 by the insertion of the sheet feed cassette 4. More specifically, the extending portion 25*c* of the elastic spring 25 starts swinging counterclockwise in FIG. 5 about the main shaft 21. Simultaneously, the push plate 24 swings counterclockwise about the main shaft 21, thereby moving up the push portion 24*b* and the contact portion 24*e* of the push plate 24.

When the push plate 24 is moved up, the contact portion 24 makes contact with the lower surface of the pressure plate 6. Then, the push plate 24 pushes up the pressure plate 6 and pivots the pressure plate 6 clockwise in FIG. 1 about the pivot shaft 6*a*. The push plate 24 urged by the elastic spring 25 moves the pressure plate 6 up further, thereby pressing a stack of sheets P placed on the pressure plate 6 against the lower surface of the sheet feed roller 7.

After that, when the sheet feed roller 7 further rotates clockwise in FIG. 9, the sheet feed roller 7 separates the uppermost sheet of the stack in cooperation with the separation pad 8. When the sheet feed roller 7 further rotates after separating the uppermost sheet, the pressure plate 6 pushed up by the push plate 24 is lowered by a predetermined distance.

To be more specific, as the sheet feed roller 7 further rotates, the drive shaft 41 is further rotated counterclockwise in FIG. 6. This makes the coupled cam 42 further rotate, and the release cam 42*a* of the coupled cam 42 comes off the pushed-down portion 34*b* of the lock 34. The pushed-down portion 34*b* is released by the release cam 42*a*. Thus, the lock 34 is urged counterclockwise about the lock shaft 33 by an elastic restoring force of the elastic spring 35, thereby bringing the lock pawl 34*a* into engagement with the ratchet pawl 32*c* of the ratchet gear 32. This engagement restricts the forward rotation (indicated by arrow B in FIG. 6) of the ratchet gear 32.

Then, the rotation of the second sub-gear 30 in mesh with the gear teeth portion 32*a* of the ratchet gear 32 is restricted and, as a result, the rotations of the driven shaft 29, the first sub-gear 28, and the driving gear 27 are restricted. By the rotation restriction on the driving gear 27, the push plate 24 engaged with the drive gear 27 through the boss 27*a* is halted at the plate upper position, as shown in FIG. 9. After that, when the sheet feed roller 7 further rotates, the drive shaft 41 is further rotated counterclockwise in FIG. 7.

Then, the push-down cam 42*b* of the coupled cam 42 is brought into contact with the pushed-down portion 38*a* of the actuating member 38. When the drive shaft 41 is further rotated by the continuous rotation of the sheet feed roller 7, the push-down cam 42*b* pushes down the pushed-down portion 38*a* of the actuating member 38. This makes the actuating member 38 swing down, against the urging force of the elastic spring 40, clockwise in FIG. 7 about the main shaft 21. When the actuating member 38 swings down, the elastic spring 40 is elongated longitudinally and a restoring elastic force is built up therein.

On the other hand, when the actuating member 38 swings down, the connecting shaft side end of the engaging member 37 is moved down, through the connecting shaft 37*c* connected into the connecting hole 38*c* of the actuating member 38, in the swing direction of the actuating member 38. Then, the engaging pawl side end of the engaging member 37 is lowered toward the actuating member 38 by an elastic restoring force of the elastic spring 39. Thus, the engaging pawl 37*b* is brought into engagement with the ratchet pawl 32*c* of the upper ratchet pawl portion 32*b* of the ratchet gear 32.

After that, when the sheet feed roller 7 further rotates, the drive shaft 41 is further rotated counterclockwise in FIG. 7. This makes the coupled cam 42 further rotate so that the push-down cam 42*b* further pushes the pushed-down portion 38*a* of the actuating member 38. Then, the actuating member 38 further swings down clockwise in FIG. 7 about the main shaft 21. Thereby, the engaging member 37 is moved in the reverse rotation direction (in the direction opposite to arrow B in FIG. 7) of the ratchet gear 32 with the engaging pawl 37*b* engaged with the ratchet pawl 32*c*. As a result, the ratchet gear 32 is rotated in reverse by a predetermined angle.

Subsequently, the gear teeth portion 32*a* of the ratchet gear 32, the ratchet gear 32, the second sub-gear 30 in mesh with the gear teeth portion 32*a*, the driven shaft 29, the first sub-gear 28, and the driving gear 27 are rotated. By the rotation of the driving gear 27, the push plate 24 is lowered to the plate standby position, as shown in FIG. 10. This makes the extending portions 25*b*, 25*c* swing down and an corresponding urging force is built up again in the elastic spring 25.

After that, the next sheet feed command is transmitted from the controller, intermittent rotation of the drive shaft 41 is started. This makes the coupled cam 42 further rotate, and the push-down cam 42*b* of the coupled cam 42 comes off the pushed-down portion 38*a* of the actuating member 38. Thus, the pushed-down portion 38*a* is released by the push-down cam 42*b*. Then, the actuating member 38 is urged by an elastic restoring force of the elastic spring 40 to swing up counterclockwise in FIG. 8 about the main shaft 21. As the actuating member 38 swings up, the engaging member 37 moves up, thereby disengaging the engaging pawl 37*b* from the ratchet pawl 32*c* of the ratchet gear 32 and returning them into a state shown in FIGS. 7 and 8. Even when the engaging pawl 37*b* is disengaged from the ratchet pawl 32*c*, the lock pawl 34*a* remains engaged with the ratchet pawl 32*c*. Thus, the push plate 24 is halted at the plate standby position as shown in FIG. 10.

When the push plate 24 is lowered by a predetermined distance from the plate upper position (as shown in FIG. 9) to the plate standby position (as shown in FIG. 10), the pressure plate 6 having been moved up by the pushed plate 24 is also lowered by a predetermined distance. As a result, a stack of sheets P placed on the pressure plate 6 falls away from the sheet feed roller 7 by a predetermined distance. In this state, a separated sheet P is fed downstream, by the sheet feed roller 7 and the driven rollers 9, 9, along the sheet feed path (in the direction indicated by arrow X1 in FIG. 1). The sheet feed direction on the upstream side is reversed from the downstream side. Specifically, the sheet P is fed upward from the sheet feed port 2*a* along the rotation direction of the sheet feed roller 7. When the sheet P reaches the upper surface of the sheet feed roller 7, the sheet feed direction is reversed from the direction (indicated by arrow X1 in FIG. 1) in which the sheet is fed from the sheet feed cassette 4 to the direction indicated by arrow X2 in FIG. 1.

The sheet P fed by the sheet feed roller 7 is conveyed over the platen 13. Then, the sheet P passes underneath the printhead 12 mounted on the carriage 14 of the printer 3 while being supported by the platen 13. While the sheet P passes underneath the printhead 12, printing is accomplished by ink ejection from the ink tank 15 through the nozzles 12*a* of the printhead 12 onto the sheet P.

The printed sheet P is conveyed by the discharge roller 16 and the pressure roller 17, through the sheet discharge port 2*b*, onto the upper surface of the cassette cover 5. The trailing edge (on the left side in FIG. 1) of the sheet P discharged onto the cassette cover 5 is held by the sheet edge-receiving portion 5*a*, while the leading edge (on the right side in FIG. 1) thereof is held by the sheet-holding portion 5*b*.

After that, the next sheet feed command is transmitted from the controller, intermittent rotation of the drive shaft 41 is started again. By the rotation of the drive shaft 41, the lock release cam 42*a* of the coupled cam 42 pushes the pushed-down portion 34*b* of the lock 34, thereby disengaging the lock pawl 34*a* of the lock 34 from the ratchet pawl 32*c* of the ratchet gear 32. Thus, the push plate 24 is moved up to the plate upper position by an elastic restoring force of the elastic spring 25. As the push plate 24 is moved up, a stack of sheets P placed on the pressure plate 6 is brought into contact with the lower surface of the sheet feed roller 7 again, as shown in FIG. 9. The next sheet P of the stack is supplied to the printer 3 so as to be printed thereon.

As described above, in the printer 1 having the sheet feeder 2 in accordance with the embodiment, the push plate 24 is lowered by a predetermined distance by the lowering mechanism 36 actuated by the coupled cam 42 when a separated sheet P is conveyed by the sheet feed roller 7. The push plate 24 is halted at the plate standby position, which is lower than the plate upper position and higher than the plate lower position, by the engagement between the ratchet pawl 32*c* and the lock pawl 34*a*. Accordingly, a sheet P separated by the sheet feed roller 7 and the separation pad 8 is not pressed against the sheet feed roller 7, and thus the rotation load of the sheet feed roller 7 can be reduced.

The push plate 24 is lowered by a predetermined distance and halted at the plate standby position, which is higher than the plate lower position, by the engagement between the ratchet pawl 32*c* and the lock pawl 34*a*. Accordingly, the push plate 24 does not need to be lowered to the plate lower position as opposed to a conventional sheet feeder. Thus, the vertical moving distance of the push plate 24 after the sheet separation is shortened. Because of the shortened moving distance of the push plate 24, impact noise produced upon the contact between a stack of sheets P on the pressure plate 6 raised by the push plate 24 and the sheet feed roller 7 is reduced.

As the moving distance of the pressure plate 6 is shortened, the moving time of the pressure plate 6 is also reduced. Thus, no expensive high-torque drive motor is required to vertically move the pressure plate 6 at high speed, resulting in a reduction in the total production cost of the sheet feeder 2.

Further, because the moving time of the pressure plate 6 is reduced as the moving distance of the pressure plate 6 is shortened, time required for a sheet P to be fed can be reduced and the sheet feed speed of the sheet feeder 2 can be increased.

Lowering of the push plate 24 by a predetermined distance to the plate stand by position is initiated by the coupled cam 42. The coupled cam 42, when rotated in response to the sheet feed roller 7, pushes the actuating member 38 and swings the engaging portion 37 in the reverse rotation direction of the ratchet gear 32. This makes the ratchet pawl portion 32*b* of the ratchet gear 32 rotate in reverse, thereby lowering the push plate 24. The driving force of the sheet feed roller 7 is used as the driving force for lowering the push plate 24. Thus, no extra drive unit such as a motor is required for lowering the push plate 24, resulting in a reduction in the total production cost of the sheet feeder 2.

When the ratchet gear 32 is rotated in reverse by a predetermined angle by the engaging member 37, the actuating member 38 is released by the coupled cam 42. This disengages the engaging member 37 from the ratchet gear 32. The disengagement restricts the reverse rotation of the ratchet gear 32 by the engaging portion 37 and prevents the push plate 24 from being lowered excessively more than a predetermined distance. Thus, the push plate 24 is lowered by a predetermined distance without the use of a position sensor or the like. As a result, the total production cost of the paper feeder 2 can be reduced.

The lock 34 engaged with the ratchet pawl 32*c* of the ratchet gear 32 restricts the forward rotation of the ratchet gear 32. By this restriction, the push plate 24 is prevented from moving up and is halted at the plate standby position.

In addition, the lock 34 permits the reverse rotation of the ratchet gear 32 while restricting the forward rotation thereof. In other words, the lock 34 permits downward movement of the push plate 24 while preventing upward movement of the push plate 24. The release cam 42*a* of the coupled cam 42, which is rotated in response to the rotation of the sheet feed roller 7, can release the lock 34 from the engagement with the ratchet gear.

The speed at which the push plate 24 is urged by the elastic spring 25 and moved up to the plate upper position is attenuated by the attenuator 31. This reduces the impact of a stack of sheets P on the pressure plate 6 with the sheet feed roller 7. Thus, a stack of sheets P on the pressure plate 6 is prevented from colliding violently with the sheet feed roller 7, and impact noise generated during upward movement of the push plate 24 is reduced.

Upon the insertion of the sheet feed cassette 4 into the cassette inserting section 1*b*, the push-up plate 4*f* makes the elastic spring 25 start generating an urging force. Before the insertion of the sheet feed cassette 4, the push plate 24 is prevented from being urged by the elastic spring 25. Thus, before the insertion of the sheet feed cassette 4, the push plate 24 is not affected by any urging force or load. Accordingly, an aged creep of the push plate 24 can be prevented.

The elastic spring 25 for urging the push plate 24 is made of an elastic material having restorable elasticity. Thus, no device, such as a motor, is required for applying an urging force to the push plate 24, and the total production cost of the sheet feeder 2 can be reduced.

While the invention has been described in connection with a preferred embodiment thereof, it will be understood that it is not intended to limit the invention to that embodiment. On the contrary, various changes may be made without departing from the spirit and scope of the invention. Although in the above-described embodiment, the sheet feeder 2 according to the invention is applied to the printer 1 as an image forming device, the invention may be applied to a document feeder mounted on an image reader.

What is claimed is:

1. A sheet feeder, comprising:

a sheet support member that supports thereon a stack of sheets;

a sheet feed roller that is rotatably disposed above one end of the sheet support member and separates a single sheet from the stack of sheets and then conveys the separated single sheet;

a pushing member that is vertically movable and pushes the sheet support member toward the sheet feed roller between a lower position where the stack of sheets is away from the sheet feed roller and an upper position where the stack of sheets is in contact with the sheet feed roller;

an urging member that urges the pushing member from the lower position to the upper position;

a lowering device that lowers the pushing member urged by the urging member by a predetermined distance from the upper position when the sheet feed roller conveys the separated single sheet;

a halting device that halts the pushing member lowered by the lowering device at a position lower than the upper position and higher than the lower position; and a halt release device that releases the halted pushing member.

2. The sheet feeder according to claim 1, wherein the lowering device comprises:

a ratchet gear having, on its outer circumference, a plurality of engaging pawls and rotated in a forward direction during upward movement of the pushing member toward the upper position and rotated in a reverse direction, which is opposite to the forward direction, during downward movement of the pushing member toward the lower position;

a first cam member rotated as the sheet feed roller rotates;

an actuating member projecting toward the first cam member and pushed by the first cam member as the sheet feed roller rotates; and an engaging member that, when the actuating member is pushed by the first cam member, engages one of the engaging pawls and swings in a same direction as the reverse rotation direction of the ratchet gear so as to rotate the ratchet gear by a predetermined angle in the reverse direction.

3. The sheet feeder according to claim 2, wherein the first cam member releases the actuating member when the ratchet gear has been rotated by the predetermined angle in the reverse direction and, upon release of the actuating member by the first cam member, the engaging member is released by the one of the engaging pawls.

4. The sheet feeder according to claim 2, wherein the halting device includes a locking member that is engageable with one of the engaging pawls and, when engaged with the one of the engaging pawls, restricts the forward rotation of the ratchet gear while permitting the reverse rotation of the ratchet gear.

5. The sheet feeder according to claim 4, wherein the halt release device includes a second cam member that is rotated as the sheet feed roller rotates and pushes the locking member so as to release engagement between the locking member and the one of the engaging pawls.

6. The sheet feeder according to claim 1, further comprising an attenuator that attenuates moving speed of the pushing member when the pushing member is moved upward by an urging force of the urging member.

7. The sheet feeder according to claim 1, further comprising a case and a sheet feed cassette detachably attached to the case and provided with the sheet support member, the sheet feed cassette including an urging force starting member that makes the urging member start generating an urging force.

8. The sheet feeder according to claim 1, wherein the urging member is made of an elastic material.

9. A sheet feeder of a printing device for feeding print medium, one sheet at a time, from a sheet cassette mounted in the printing device, the sheet feeder comprising:

a sheet feed roller disposed above one end of the sheet cassette when mounted in the printing device;

a main shaft;

an urging arm fixedly mounted to the main shaft, the urging arm contacting a plate member of the sheet cassette;

a push plate mounted to the main shaft;

a drive mechanism rotatably mounted to the main shaft, the drive mechanism engaging the push plate;

a locking member engaged with the drive mechanism to prevent the rotation of the drive mechanism around the main shaft in a first direction;

a lowering device for causing a rotation of the drive mechanism in a second direction, opposite the first direction, for a predetermined distance; and a force application device fixedly connected between the main shaft and the push plate that applies a force in the first direction to the push plate when the sheet cassette is mounted in the printing device, wherein the push plate engages an underside of a sheet support plate that is part of the sheet cassette to cause the support plate to take one of three positions.

10. The sheet feeder according to claim 9, wherein the three positions comprise a lower position wherein the sheet support plate is substantially parallel to a bottom of the sheet cassette; an upper position wherein a top sheet of the recording medium contacts the feel roller; and a standby position wherein the top sheet is separated from the feed roller by the predetermined distance.

11. The sheet feeder according to claim 9, wherein the urging arm comprises:

contact protrusion that engages a ramped surface of the plate member of the sheet cassette to cause the main shaft to rotate in the first direction during cassette insertion; and an elastic member for urging the urging arm in the second direction.

12. The sheet feeder according to claim 9, wherein the drive mechanism comprises:

a driving gear rotatably mounted to the main shaft;

a first sub-gear engaged with the driving gear;

a driven shaft;

a second sub-gear, the first sub-gear and second sub-gear fixedly mounted at opposite ends of the driven shaft; and a ratchet gear having a ratchet portion and a gear portion engaged with the second sub-gear.

13. The sheet feeder according to claim 12, wherein the driving gear is drivingly engaged with the push plate.

14. The sheet feeder according to claim 12, wherein the locking member comprises:

a lock arm pivotally mounted in the printing device, the lock arm having a pawl at an end away from the pivotal mount; and an elastic member for rotating the lock arm in the first direction to engage the pawl with a ratchet of the ratchet portion of the ratchet gear.

15. The sheet feeder according to claim 14, wherein the lowering device comprises:

a coupled cam drivingly linked to the sheet feed roller;

an actuating member pivotally mounted on the main shaft; and an engaging member mounted to and end of the actuating member away from the pivotal mount of the actuating member, the engaging member having an engaging pawl at an end away from the mount to the actuating member, wherein the coupled cam has a push-down cam for engaging the actuating member causing the actuating member to rotate in the second direction to engage the engaging pawl with a ratchet of the ratchet portion of the ratchet gear.

16. The sheet feeder according to claim 15, wherein the coupled cam further comprises a release cam for engaging the lock arm and releasing the pawl from the ratchet portion.

17. The sheet feeder according to claim 15, further comprising an elastic device for causing the actuating member to rotate in the first direction around the main shaft.

18. The sheet feeder according to claim 12, further comprising an attenuating mechanism operatively connected to the second sub-gear.

19. The sheet feeder according to claim 18, wherein the attenuating mechanism comprises means for slowing rotation of the second sub-gear.

20. The sheet feeder according to claim 18, wherein the attenuating mechanism comprises:

a transfer gear engaging the second sub-gear;

a case filled with a viscous material; and an impeller operatively connected to the transfer gear and mounted in the case.

* * * * *